US010810841B2

(12) United States Patent
Nelson et al.

(10) Patent No.: US 10,810,841 B2
(45) Date of Patent: Oct. 20, 2020

(54) COMBINED INTERACTIVE GAMING AND BETTING DEVICE AND METHOD

(71) Applicant: IGT, Las Vegas, NV (US)

(72) Inventors: Dwayne Nelson, Las Vegas, NV (US); Kevin Higgins, Reno, NV (US); Patrick Danielson, Las Vegas, NV (US); Cameron Filipour, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/202,263

(22) Filed: Nov. 28, 2018

(65) Prior Publication Data

US 2020/0168049 A1 May 28, 2020

(51) Int. Cl.
*G07F 17/32* (2006.01)

(52) U.S. Cl.
CPC ..... *G07F 17/3288* (2013.01); *G07F 17/3209* (2013.01); *G07F 17/3213* (2013.01); *G07F 17/3225* (2013.01)

(58) Field of Classification Search
CPC ..... G07F 17/3267; G07F 17/3288
See application file for complete search history.

(56) References Cited

U.S. PATENT DOCUMENTS 5,770,533 A * 6/1998 Franchi ..... G07F 17/0014 463/16
7,828,656 B2 * 11/2010 Paulsen ..... G07F 17/3227 463/29
8,142,279 B2 * 3/2012 Benrus ..... G07F 17/3288 463/25
8,216,043 B1 * 7/2012 Perrone ..... G07F 17/326 463/16
8,323,105 B2 * 12/2012 Chun ..... G07F 17/3262 463/25
8,535,140 B2 * 9/2013 Alderucci ..... G07F 17/32 463/20
9,033,798 B2 * 5/2015 O'Brien ..... G06Q 50/34 463/31
2002/0183105 A1 * 12/2002 Cannon ..... G07F 17/32 463/16
2004/0106454 A1 * 6/2004 Walker ..... G07F 17/32 463/42
2004/0137978 A1 * 7/2004 Cole ..... G07F 17/32 463/16

(Continued)

*Primary Examiner* — Steven J Hylinski
(74) *Attorney, Agent, or Firm* — Sheridan Ross P.C.

(57) ABSTRACT

The present disclosure relates generally to gaming systems and methods that that integrate competitive betting and interactive gaming functions in a single gaming device. The gaming device allows a player to place a bet on a competitive contest as well as play a casino game at the gaming device at the same time. The presentation output and behavior of the casino game played on the gaming device are based on events associated with the competitive contest, as the events happen in real time. In one example, the gaming device alters a display of elements in the casino game based on an event in the competitive contest. In another example, the gaming device, alters the scoring behavior or speed of the casino game based on an event in the competitive contest. Aspects of the present disclosure provide an enhanced gaming experience tied to sports betting at a gaming device.

20 Claims, 11 Drawing Sheets

(56) References Cited

U.S. PATENT DOCUMENTS

2004/0204232 A1* 10/2004 Asher ..... G06Q 50/34 463/25
2004/0235542 A1* 11/2004 Stronach ..... G06Q 30/06 463/6
2005/0187020 A1* 8/2005 Amaitis ..... G07F 17/32 463/42
2005/0245306 A1* 11/2005 Asher ..... G07F 17/32 463/16
2007/0077997 A1* 4/2007 Johnson ..... G07F 17/32 463/42
2007/0257429 A1* 11/2007 Kane ..... G07F 17/32 273/138.1
2008/0102916 A1* 5/2008 Kovacs ..... G07F 17/3211 463/16
2008/0197573 A1* 8/2008 Palmer ..... A63F 1/04 273/298
2008/0254881 A1* 10/2008 Lutnick ..... G07F 17/32 463/31
2008/0261683 A1* 10/2008 Russell ..... G07F 17/32 463/26
2009/0082095 A1* 3/2009 Walker ..... G07F 17/32 463/25
2010/0041453 A1* 2/2010 Grimm, Jr. ..... G07F 17/32 463/6
2010/0160012 A1* 6/2010 Amaitis ..... G06Q 50/34 463/2
2010/0240455 A1* 9/2010 Gagner ..... G07F 17/32 463/30
2010/0259005 A1* 10/2010 Simon ..... A63F 1/00 273/292
2011/0223980 A1* 9/2011 Stearns ..... G07F 17/32 463/1
2012/0071223 A1* 3/2012 Sharkov ..... G07F 17/32 463/20
2012/0264504 A1* 10/2012 Gagner ..... G07F 17/323 463/25
2015/0005059 A1* 1/2015 Johnson ..... G07F 17/3227 463/25
2015/0221177 A1* 8/2015 Glancy ..... G07F 17/3288 463/25
2016/0110965 A1* 4/2016 Arnone ..... G07F 17/326 463/25
2016/0171835 A1* 6/2016 Washington ..... G07F 17/3244 463/25
2017/0046905 A1* 2/2017 Ramos ..... G07F 17/3209

* cited by examiner

COMBINED INTERACTIVE GAMING AND BETTING DEVICE AND METHOD

BACKGROUND

The present disclosure is generally directed to gaming systems, in particular, toward casino gaming and wagering systems.

Casinos generally include a number of betting terminals and gaming machines that are strategically distributed at various locations throughout a facility. Each of these discrete devices is configured to provide a specific service or type of transaction to a user. For instance, a sports betting terminal allows a user to place bets on specified outcomes associated with competitive sports, while the gaming machines may enable a gaming activity associated with one or more games of chance or games of skill.

BRIEF SUMMARY

In certain embodiments, the present disclosure relates to a system, device, and method that provide enhanced betting and gaming functions from a single gaming device. In some embodiments, a computer gaming device and betting terminal is provided, comprising: a display device; a communications interface; a processor coupled to the display device and the communications interface; and a memory coupled with and readable by the processor and storing therein a set of instructions that, when executed by the processor, causes the processor to: render an interactive game to a first portion of the display device in a first presentation; receive, via the communications interface, information from a betting system comprising betting events associated with competitive contests; render the information received from the betting system to a second portion of the display device; receive input from a user interacting with the computer gaming device placing a bet on a particular contest of the competitive contests; and send, via the communications interface, a signal comprising information defining the bet to the betting system on behalf of the user.

In some embodiments, a method for providing interactive gaming and competitive contest wagering at a gaming device is provided, comprising: rendering, via a processor of the gaming device, an interactive game to a first portion of a screen of the gaming device in a first presentation; receiving, via a communications interface of the gaming device, information from an online wagering system comprising wagering events associated with competitive contests; rendering, via the processor, the information received from the online wagering system to a second portion of the screen; receiving, via an input device of the gaming device, input from a user interacting with the gaming device placing a wager on a particular contest of the competitive contests; and sending, via the communications interface, a signal comprising information defining the wager to the online wagering system on behalf of the user.

In some embodiments, a system for placing bets via a gaming terminal is provided, comprising: a betting server; and a gaming terminal in communication with the betting server, the gaming terminal comprising: a display device; a communications interface; a processor coupled to the display device and the communications interface; and a memory coupled with and readable by the processor and storing therein a set of instructions that, when executed by the processor, causes the processor to: render an interactive game to a first portion of the display device in a first presentation; receive, via the communications interface, information from the betting server comprising betting events associated with competitive contests; render the information received from the betting server to a second portion of the display device; receive input from a user interacting with the gaming terminal placing a bet on a particular contest of the competitive contests; and send, via the communications interface, a signal comprising information defining the bet to the betting server on behalf of the user.

Additional features and advantages are described herein and will be apparent from the following Description and the figures.

DETAILED DESCRIPTION

Figure 1:
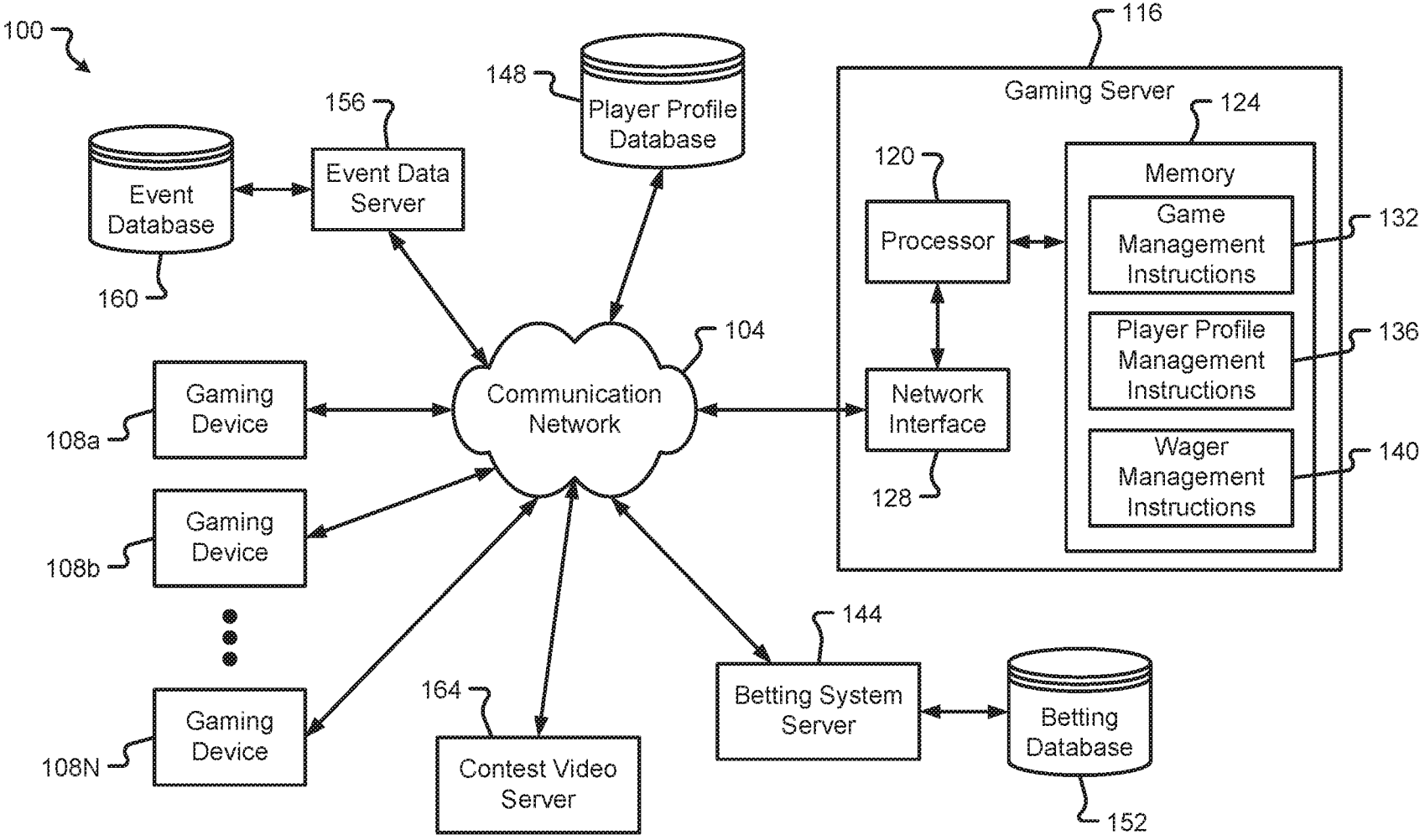
FIG. 1 is a block diagram of a gaming system accordance with embodiments of the present disclosure.

Embodiments of the present disclosure will be described in connection with a gaming system having one or multiple gaming devices that enable gaming activity. While certain embodiments of the present disclosure will reference the use of an Electronic Gaming Machine (EGM) as a device that enables players to participate in gaming activity, it should be appreciated that embodiments of the present disclosure are not so limited. For instance, any computing device, personal gaming device, mobile phones, mobile devices, sports betting kiosk including gaming functionality, or collection of computing devices may be used to facilitate player engagement with a gaming system.

Embodiments of the present disclosure provide systems and methods that integrate competitive contest betting and interactive gaming functions in a single gaming device. Competitive contest betting may refer to betting associated with competitive contests (e.g., contests that are separate and apart from events associated with a gaming device or gaming at a casino) including, but in no way limited to, sports betting, outcome betting, race betting, horse race betting, dog race betting, etc. In some embodiments, the gaming device may allow competitive contest betting and provide traditional casino and interactive gaming such as video poker, slots, bingo, blackjack, skill games, electronic table games (e.g., live roulette, baccarat, etc.), and keno. Historically, slot machines and sports betting terminals are separate devices due in part to the regulatory scrutiny and costs associated with each machine. As such, people playing at gaming machines who wish to place bets on competitive contests are required to leave their gaming machines to find a betting terminal where their betting transactions may be made. A sports betting kiosk, or sports betting terminal, is usually considered to have a lower level of regulatory scrutiny than other types of casino equipment (e.g., such as gaming devices, etc.). If a casino game is added to the terminal the machine would be considered a "gaming terminal" and, as a result, the regulatory requirements associated therewith greatly increase. As can be appreciated, this increase in regulatory requirements would increase the cost of the cabinet and software for the gaming device. Embodiments of the present disclosure describe various ways of integrating competitive contest betting and casino games in a gaming device to increase the value of the gaming device, enhance the gaming experience, and offer both competitive contests betting and casino gaming in a single device. In addition to offering exciting new ways to gamble and game, the present disclosure provides numerous benefits associated with the increased cost of the gaming device.

In some embodiments, the gaming device may be configured with one or more casino games such as skill games, Poker, Slots, Keno, Bingo or Blackjack. The gaming device is also configured to allow a player to place competitive contest bets from a sports/race book. The player may be able to watch sports/race bets, live sporting events, live horse racing events, live competitive contests, etc., on the gaming device. It is an aspect of the present disclosure that the gaming device may learn about events in the competitive contests and dynamically alter the casino game (e.g., in real-time, near-real-time, etc.). The gaming device learns about competitive contests from one or more competitive contest betting terminals or servers. By way of example, a betting system server may receive information from one or more event data servers that record events associated with competitive contests (e.g., sports games, races, etc.). These events may include occurrences in or outcomes of game play, chance, interactions, and/or other instances associated with the competitive contests. Information about the events may be sent to the gaming device, which in turn may determine to alter a behavior of an interactive game, presentation, or reward system associated with the gaming device.

The gaming device can learn which games the player is betting on and which teams the player is betting on based on input received at the gaming device and/or from information received from the betting system server host. During live play of the game individual events may be sent to and/or received by the gaming device. For example, the gaming device will learn about race events, scoring in a game, referee calls, fumbles, scores, dunks, arguments, wins, and penalties. Based on this information, the gaming device may modify the casino game visually (e.g., by changing a display presentation, game behavior, speed, sound, etc.) or financially (e.g., by adding score multipliers, offering awards, enrolling a player into a wager pool, and the like).

With reference initially to FIG. 1, details of an illustrative gaming system 100 will be described in accordance with at least some embodiments of the present disclosure. The components of the gaming system 100, while depicted as having particular instruction sets and devices, is not necessarily limited to the examples depicted herein. Rather, a system according to embodiments of the present disclosure may include one, some, or all of the components depicted in the system 100 and does not necessarily have to include all of the components in a single device. For instance, the components of a server may be distributed amongst a plurality of servers and/or other devices (e.g., an EGM, portable user device, etc.) in the system 100 without departing from the scope of the present disclosure.

The gaming system 100 is shown to include a communication network 104 that interconnects and facilitates machine-to-machine communications between one or multiple gaming devices 108*a*-N, a gaming server 116, a betting system server 144, an event data server 156, and a contest video server 164. It should be appreciated that the communication network 104 may correspond to one or many communication networks without departing from the scope of the present disclosure. In some embodiments, the gaming devices 108*a*-N and server(s) 116, 144, 156, 164 may be configured to communicate using various nodes or components of the communication network 104. The communication network 104 may comprise any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may comprise a number of different communication media such as coaxial cable, copper cable/wire, fiber-optic cable, antennas for transmitting/receiving wireless messages, and combinations thereof.

In some embodiments, the gaming devices 108*a*-N may be distributed throughout a single property or premises (e.g., a single casino floor) or the gaming devices 108*a*-N may be distributed among a plurality of different properties. In a situation where the gaming devices 108*a*-N are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming devices 108*a*-N may utilize the same or different types of communication protocols to connect with the communication network 104. It should also be appreciated that the gaming devices 108*a*-N may or may not present the same type of game to a player. For instance, the first gaming device 108*a* may correspond to a gaming machine that presents a slot game to the player, the second gaming device 108*b* may correspond to a video poker machine, and other gaming devices may present other types of games or a plurality of different games for selection and eventual play by the player. It may be possible for the some of the gaming devices 108*a*-N to communicate with one another via the communication network 104. In some embodiments, one or more of the gaming devices 108*a*-N may only be configured to communicate with a centralized management server and/or the gaming server 116. Although not depicted, the system 100 may include a separate server or collection of servers that are responsible for managing the operation of the various gaming devices 108*a*-N in the gaming system 100. It should also be appreciated that the gaming server 116 may or may not be co-located with one or more gaming devices 108*a*-N in the same property or premises. Thus, one or more gaming devices 108*a*-N may communicate with the gaming server 116 over a WAN, such as the Internet. In such an event, a tunneling protocol or Virtual Private Network (VPN) may be established over some of the communication network 104 to ensure that communications between a gaming device (e.g., an EGM, etc.) and a remotely-located server 116 are secured.

The gaming devices 108*a*-N may correspond to a type of device that enables player interaction in connection with playing games of chance as well as interaction in connection with a betting system. A gaming device 108*a*-N may include any type of known gaming device such as an EGM, a slot machine, a table game, an electronic table game (e.g., video poker), a skill-based game, etc., combined with functionality of a betting terminal. In addition to placing bets and playing games on a gaming device 108*a*-N, the player may also be allowed to interact with and play games of chance on a mobile device. A mobile device may correspond to a player's personal device or to a device issued to the player during the player's visit at a particular casino. It should be appreciated that the player may play games directly on their mobile device and/or the mobile device may be in communication with a gaming device 108*a*-N such that the mobile device provides the interface for the player to the gaming device 108*a*-N. As shown in FIG. 1, the mobile device may be in communication with the communication network 104 or in direct communication (e.g., via Bluetooth, WiFi, etc.) with a gaming device 108*a*-N. Non-limiting examples of a mobile device include a cellular phone, a smart phone, a tablet, a wearable device, an augmented reality headset, a virtual reality headset, a laptop, a Personal Computer (PC), or the like.

The gaming server 116 is further shown to include a processor 120, memory 124, and a network interface 128. These resources may enable functionality of the gaming server 116 as will be described herein. For instance, the network interface 128 provides the server 116 with the ability to send and receive communication packets or the like over the communication network 104. The network interface 128 may be provided as a network interface card (NIC), a network port, drivers for the same, and the like. Communications between the components of the server 116 and other devices connected to the communication network 104 may all flow through the network interface 128.

The processor 120 may correspond to one or many computer processing devices. For instance, the processor 120 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 120 may be provided as a microprocessor, Central Processing Unit (CPU), or plurality of microprocessors that are configured to execute the instructions sets stored in memory 124. Upon executing the instruction sets stored in memory 124, the processor 120 enables various game management, player authentication, and wager management functions of the gaming server 116.

The memory 124 may include any type of computer memory device or collection of computer memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions. Although not depicted, the memory 124 may include instructions that enable the processor 120 to store data into a player profile database 148 and/or a betting database 152 and retrieve information from the databases 148, 152. Alternatively or additionally, the player profile database 148 or data stored therein may be stored internal to the server 116 (e.g., within the memory 124 of the server 116 rather than in a separate database). Alternatively or additionally, the betting database 152 or data stored therein may be stored internal to the gaming server 116 or the betting system server 144.

The illustrative instruction sets that may be stored in memory 124 include, without limitation, a game management instruction set 132, a player profile management instruction set 136, and a wager management instruction set 140. Functions of the server 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the server 116. Said another way, the particular instruction sets depicted in FIG. 1 should not be construed as limiting embodiments described herein.

The game management instruction set 132, when executed by the processor 120, may enable the gaming server 116 to manage the various games played by a player at the gaming devices 108*a*-N and/or a mobile device carried by the player. In other words, any game played by the player at one or more of the devices 108*a*-N may be managed, partially or entirely, by execution of the game management instruction set 132. The game management instruction set 132 may also be configured to track a status of wager events (e.g., competitive contest events, bingo, keno, lottery, etc.) and whether a player has placed a wager on such events. In some embodiments, when a wager event has come to completion such that wagers made on the event become payable (e.g., at the end of a sporting event when the final score of the event is determined), the game management instruction set 132 may notify the player profile management instruction set 136, thereby enabling the player profile management instruction set 136 to update states and/or values of wagers, play history, etc., for the player.

The player profile management instruction set 136, when executed by the processor 120, may enable the gaming server 116 to manage one or more data fields for a player profile, for example, stored in the player profile database 148 and/or cause a gaming device 108*a*-N to update an appropriate credit meter for the player within the gaming device being played by the player. In some embodiments, the player profile management instruction set 136 may be configured to create one or more player profiles and associated data structures within the player profile database 148. A player profile, in some embodiments, may include player identification information and a wager account record for the player. In some embodiments, the player profile management instruction set 136 may be responsible for managing electronic records of all players within the gaming system 100 or a subset of players within the gaming system 100. In some embodiments, the player profile management instruction set 136 may be responsible for updating a player profile to indicate that an associated player 112 is attempting to earn a bonus or jackpot based on an aggregation of events that can occur within the gaming system 100. The player profile management instruction set 136 may be configured to work in synchronization with the game management instruction set 132 and/or wager management instruction set 140 to update a player profile in response to a player 112 completing one or a plurality of events defined for a bonus or jackpot based on the aggregation of events that can occur within the gaming system 100.

In some embodiments, the wager management instruction set 140, when executed by the processor 120, may enable the gaming server 116 to manage various bets, or wagers, made by players via gaming devices 108*a*-N, manage interactions between the gaming server 116, the betting system server 144, and the event data server 156, determine a status of bets placed at the gaming devices 108*a*-N, update the betting database 152, obtain information from the betting database 152 and the event data server 156, and determine award amounts for players at the gaming devices 108*a*-N. In some embodiments, the wager management instruction set 140 is configured to perform any action consistent with receiving bets placed by a player at a gaming device 108, determining whether the player is authorized to place the bet, and communicating with the betting system server 144. In some embodiments, the wager management instruction set 140 may be configured to generate, or cause the game management instruction set 132 to generate, a synthesized credit meter for a gaming device 108. For instance, as gaming devices 108*a*-N or a mobile device have their credit meters updated, the gaming server 116 may update a corresponding synthesized credit meter to reflect updates at the credit meters. In some embodiments, values of credit or other events stored in credit meters of devices 108 may be mirrored in a synthesized credit meter maintained by the gaming server 116.

The gaming system 100 may comprise a betting system server 144 that determines wagering options and events, sets odds, and accepts bets made by players at one or more gaming devices 108*a*-N. The betting system server 144 may be an online sportsbook and/or racebook that is accessible across the communication network 104. Similar to the gaming server 116, the betting system server 144 may comprise a processor 120, memory 124, and a network interface 128, as described above. In some embodiments, the memory 124 of the betting system server 144 may comprise different instructions than the memory 124 of the gaming server 116. Upon receiving a bet on a competitive contest (e.g., placed by a player at a gaming device 108), the betting system server 144 may store the bet in the betting database 152. As provided above the competitive contests may include, but are in no way limited to, matches, games, races (e.g., horse races, dog races, political races, etc.), competitions, boxing events, fighting events (e.g., boxing, mixed martial arts (MMA), wrestling, judo, karate, etc.), entertainment events, organized events, shows, combinations thereof, and/or discrete betting events associated with the same.

The event data server 156 may correspond to a server that tracks and records events or occurrences associated with competitive contests. These events may include, but are in no way limited to, scores, positions, plays, penalties, errors, injuries, calls, reviews, outcomes, results, times associated therewith, and/or the like. In some embodiments, these events may be automatically determined, via a processor, recognizing the occurrence of an event during a competitive contest. In one embodiment, these events may be manually recorded by one or more individuals recording information about a competitive contest and manually entering the information into one or more fields provided by an application run on, or hosted by, the event data server 156. Examples of typical events associated with a competitive contest, like American football for instance, may include instances or occurrences such as fumbles, pass completions, incomplete passes, interceptions, punts, downs made, yards gained, timeouts taken, field goals, safeties, extra points, and touchdowns, to name a few. These events may be cataloged, associated with a particular team and/or game, and stored along with a time of the event in a memory device such as event database 160. Similar to the gaming server 116, the betting system server 144 may comprise a processor 120, memory 124, and a network interface 128, as described above.

The contest video server 164 may correspond to server comprising a processor 120, memory 124, and a network interface 128, similar, if not identical, to those described in conjunction with gaming server 116 above. The contest video server 164 may be configured to host and provide live video of one or more competitive contests bet on by a player in the gaming system 100. In some embodiments, the contest video server 164 may be interconnected with the communication network 104 and may provide video or other live streaming content via a real-time streaming protocol (RTSP), data over cable service interface specification (DOCSIS), or other communications protocol. The contest video server 164, while shown as part of the gaming system 100, may be hosted and/or operated by a multiple-system operator (MSO), such as a satellite television, internet entertainment, or cable company. In any event, embodiments of the present disclosure describe receiving video, live streams or feeds, and/or other content from the contest video server 164 and rendering such information, at least in part, to the one or more gaming devices 108*a*-N.

Figure 2:
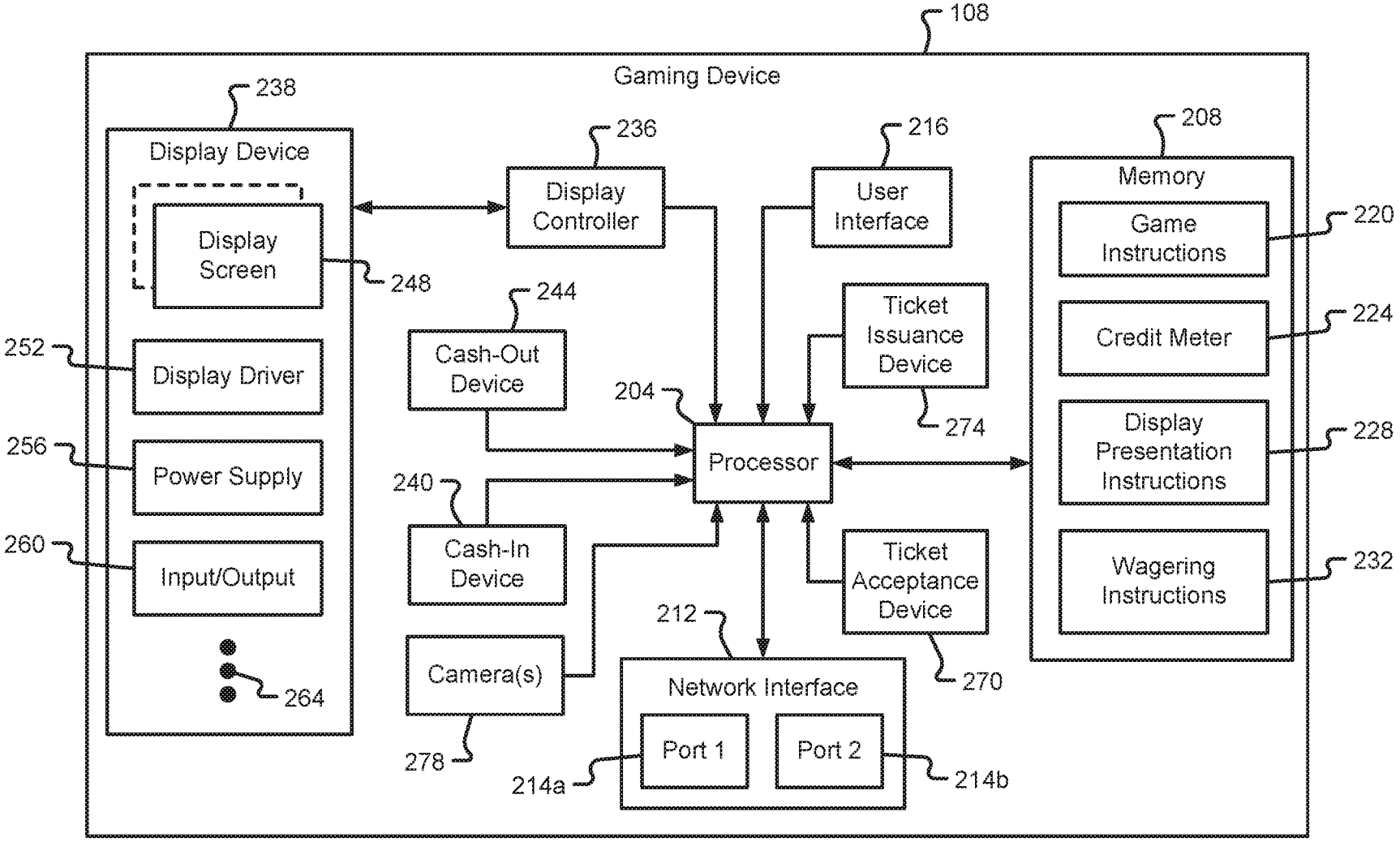
FIG. 2 is a block diagram depicting an illustrative gaming device in accordance with embodiments of the present disclosure.

With reference now to FIG. 2, additional details of a gaming device 108 will be described in accordance with at least some embodiments of the present disclosure. While depicted as a gaming device 108, it should be appreciated that some or all of the components of the gaming device 108 may be included in a player's mobile device without departing from the scope of the present disclosure.

The gaming device 108 is depicted to include a processor 204, memory 208, a network interface 212, a user interface 216, a display controller 236, a display device 238, a cash-in device 240, a cash-out device 244, a ticket acceptance device 270, a ticket issuance device 274, and one or more cameras 278. In some embodiments, the processor 204 may be similar or identical to the processor 120. In other words, the processor 204 may correspond to one or many microprocessors, CPUs, microcontrollers, or the like. The processor 204 may be configured to execute one or more instruction sets stored in memory 208.

The network interface 212 may also be similar or identical to network interface 128. The nature of the network interface 212, however, may depend upon whether the network interface 212 is provided in a gaming device 108 or a mobile user device. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the gaming device 108 is connecting to a single communication network 104 or multiple different types of communication networks 104. For instance, the gaming device 108 may be provided with both a wired network interface and a wireless network interface without departing from the scope of the present disclosure. In some embodiments, the network interface 212 may include different communications ports 214 that interconnect with various input/output lines. For example, a first communications port 214*a* may provide an interconnection (e.g., via at least one Ethernet, RJ-11, RJ-45, or other communications port) between the network interface 212 and the gaming server 116 or other servers 144, 156 in the gaming system 100. Continuing this example, a second communications port 214*b* of the network interface 212 may provide an interconnection between the network interface 212 and the contest video server 164. In this manner, the gaming device 108 may allow for the transfer of information from more than one servers 116, 144, 156 in the gaming system 100, while simultaneously receiving at least one video feed from the contest video server 164.

The user interface 216 may correspond to any type of input and/or output device that enables the player to interact with the gaming device 108. As can be appreciated, the nature of the user interface 216 may depend upon the nature of the gaming device 108. For instance, if the gaming device 108 includes a mechanical reel slot machine game, then the user interface 216 may include one or more mechanical reels, or virtual rendered reels, with symbols provided thereon, one or more lights or LED displays, one or more depressible buttons, a lever or "one armed bandit handle," a speaker, or combinations thereof. If the gaming device 108 is a digital device, then the user interface 316 may include one or more touch-sensitive displays, LED/LCD display screens, etc.

The memory 208 may be similar or identical to memory 124. For instance, the memory 208 may include one or multiple computer memory devices that are volatile or non-volatile. The memory 208 may be configured to store instruction sets that enable player interaction with the gaming device 108, that enable game play at the gaming device 108, and/or that enable coordination with the gaming server 116. Examples of instruction sets that may be stored in the memory 308 include a game instruction set 220, a credit meter 224, a display presentation instruction set 228, a wagering instruction set 232, and/or other instruction sets such as a ticket/voucher management instruction set and the like.

In some embodiments, the game instructions 220, when executed by the processor 204, may enable the gaming device 108 to facilitate one or more games of chance or skill and produce interactions between the player and the game of chance or skill. In some embodiments, the game instructions 220 may include subroutines that present one or more graphics to the player via the user interface 216, subroutines that calculate whether a particular wager has resulted in a win or loss during the game of chance or skill, subroutines for determining payouts for the player in the event of a win, subroutines for exchanging communications with a connected server (e.g., game management server, gaming server 116, or the like), subroutines for enabling the player to engage in a game using their mobile user device, and any other subroutine or set of instructions that facilitate gameplay at or in association with the gaming device 108.

The credit meter 224 may correspond to a secure instruction set and/or data structure within the gaming device 108 that facilitates a tracking of activity at the gaming device 108. In some embodiments, the credit meter 224 may be used to store or log information related to various player activities and events that occur at the gaming device 108. The types of information that may be maintained in the credit meter 224 include, without limitation, player information, available credit information, wager amount information, and other types of information that may or may not need to be recorded for purposes of accounting for wagers placed at the gaming device 108 and payouts made for a player during a game of chance or skill played at the gaming device 108. In some embodiments, the credit meter 224 may be configured to track coin-in activity, coin-out activity, coin-drop activity, jackpot paid activity, bonus paid activity, credits applied activity, external bonus payout activity, ticket/voucher in activity, ticket/voucher out activity, timing of events that occur at the gaming device 108, and the like. In some embodiments, certain portions of the credit meter 224 may be updated in response to outcomes of a game of chance or skill played at the gaming device 108 and/or in response to occurrences or outcomes of events associated with competitive contests the player bet on at the gaming device 108. In some embodiments, the credit meter 224 may be updated depending upon whether the gaming device 108 is issuing a ticket/voucher, being used as a point of redemption for a ticket/voucher, and/or any other activity associated with a ticket/voucher. Some or all of the data within the credit meter 224 may be reported to the gaming server 116, for example, if such data applies to a centrally-managed game and/or a status of a ticket/voucher. As an example, the number, value, and timing of wagers placed by a particular player and payouts on such wagers may be reported to the gaming server 116.

The display presentation instruction set 228, when executed by the processor 204, may enable the gaming device 108 to provide various display and/or auditory presentations for a game played on the gaming device 108 based on an event, or an outcome of an event, associated with a competitive contest the player has bet on from the gaming device 108. In some embodiments, the display presentation instruction set 228 may alter a display presentation of the game based on the bet placed. For instance, when a player places a bet on a particular sports team, the display presentation instruction set 228 may determine to alter a background image, icons, and/or interactive elements of the game played on the gaming device 108 to render elements that reference the particular sports team (e.g., including logos, team colors, mascots, and/or other team relevant information). Additionally or alternatively, the display presentation instruction set 228 may instruct one or more speakers of the gaming device 108 to play the particular team's fight song, play sounds from players on the particular team, and/or play soundbites from broadcasts of current or past games associated with the particular team. The display presentation instruction set 228 may provide one or more commands to the display controller 236 and the display device 238 to control a rendered output throughout a player's gaming session at the gaming device 108.

The wagering instruction set 232, when executed by the processor 204, may enable the gaming device 108 to receive information from a betting system server 144, receive input from a player (e.g., via the user interface 216, etc.) placing a bet on a particular competitive contest included in the information, and send a signal defining the bet placed to the betting system server 144 via the network interface 212 of the gaming device 108. The wagering instruction set 232 may command the one or more cameras 278 of the gaming device 108 to take at least one image of the player placing the bet. The image information obtained from the player may be sent to the gaming server 116 and/or the betting system server 144 in determining whether the player is authorized to place a bet. In some embodiments, the wagering instruction set 232 may include rules that define when the image information of a player is required (e.g., when a player exceeds a maximum allowable betting amount limit, when the player exceeds a maximum number of bets over a time period, when age limits define who may place bets in a casino, when fraud is suspected, etc.). In any event, the wagering instruction set 232 may work in conjunction with the display presentation instruction set 228 to render betting information obtained from the betting system server 144 to a display device 238 of the gaming device 108. Additionally or alternatively, the wagering instruction set 232 may work with the game instruction set 220 to alter a game behavior, score multiplier, and/or other feature of the game played on the gaming device 108 based on the betting information and wagers made by the player.

In some embodiments, a ticket/voucher management instruction set may be included in the memory 208 to work in conjunction with other instruction sets stored therein. Activities of the gaming device 108 related to ticket/voucher activity may be managed and reported by a ticket/voucher management instruction set. In some embodiments, when a ticket/voucher is redeemed at the gaming device 108 by the player 112, information associated with the ticket/voucher may be obtained by the ticket/voucher management instruction set and reported to the gaming server 116 and/or the betting system server 144. Furthermore, the ticket/voucher management instruction set may be configured to update the credit meter 224 if a redeemed ticket/voucher is determined to be in a redeemable state and has a redeemable or redemption value associated therewith. In some embodiments, the credit meter 224 may be updated or incremented by the redeemable or redemption value of the ticket/voucher when redeemed. This information may be obtained directly from the ticket/voucher or may require some interactions with the gaming server 116 prior to updating the credit meter 224.

The gaming device 108 may include one or more display devices 238 configured to render information, games, interactive elements, and/or other visual output to one or more display screens 248. The gaming device 108 may include one or more display controllers 236 configured to control an operation of the display device 238. This operation may include the control of input (e.g., player input via the user interface 216, command input via the instruction sets in memory 208, combinations thereof, etc.), output (e.g., display, rendered images, visual game behavior, etc.) and/or other functions of the display device 238.

The display device 238 may one or more display screens 248 that are configured to selectively activate pixels and/or display elements to render one or more games, windows, indicators, interactive elements, icons, characters, lights, images, etc. Examples of the display screen 248 may include, but are in no way limited to, a liquid crystal display (LCD), a light-emitting diode (LED) display, an electroluminescent display (ELD), an organic LED (OLED) display, and/or some other two-dimensional and/or three-dimensional display. In some embodiments, the one or more display screens 248 may be separated into a main display and a secondary display. In a gaming device 108 context, the main display may correspond to a display arranged in a first viewing position of a player and the secondary display may correspond to a display arranged in a second (e.g., higher) viewing position of the player. It is an aspect of the present disclosure that the gaming device 108 may include any number of display screens 248 in any arrangement or orientation (e.g., stacked, side-by-side, staggered, overlapped, angled, and/or combinations thereof). As described herein the display device 238 may be configured to render information in one or more discrete areas (e.g., windows, zones, backgrounds, etc.) of the display screen 248 or superimposed in an area of the display screen 248.

The display device 238 may include a display driver 252, a power supply 256, an input/output 260, and/or other components 264 configured to enable operation of the display device 238. The display driver 252 may receive commands and/or other data provided by the processor 204 and one or more of the instruction sets in memory 208. In response to receiving the commands, the display driver 252 may be configured to generate the driving signals necessary to render the appropriate images to the display screen 248. The power supply 256 may provide electric power to the components of the display device 238. In some embodiments, the power supply 256 may include a transformer and/or other electronics that prevent overloading, condition power signals, and/or provide backup power to the display device 238. The input/output 260 may correspond to one or more connections for receiving or exchanging information and/or video from components of the gaming device 108. The input/output 260 may include an interconnection to the network interface 212. For example, the input/output 260 may include a high-definition multimedia interface (HDMI) input, Ethernet, composite video, component video, or other video connection. In some embodiments, the display device 238 may be configured to receive a live video feed via the input/output 260 and the network interface 212.

The cash-in device 240 may include a bill acceptor, a coin acceptor, a chip acceptor or reader, or the like. In some embodiments, the cash-in device may also include credit card reader hardware and/or software. The cash-out device 244, like the ticket issuance device 270, may operate and issue cash, coins, tokens, or chips based on an amount indicated within the credit meter 224. In some embodiments, the cash-out device 244 may include a coin tray or the like and counting hardware configured to count and distribute an appropriate amount of coins or tokens based on a player's winnings or available credit within the credit meter 224.

Because the gaming device 108 may be used for the acceptance and issuance of tickets/vouchers, the gaming device 108 may be provided with appropriate hardware to facilitate such acceptance and issuance. Specifically, the gaming device 108 may be provided with a ticket acceptance device 270 that is configured to accept or scan physically-printed tickets/vouchers and extract appropriate information therefrom. In some embodiments, the ticket acceptance device 270 may include one or more machine vision devices (e.g., a camera, IR scanner, optical scanner, barcode scanner, etc.), a physical ticket acceptor, a shredder, etc. The ticket acceptance device 270 may be configured to accept physical tickets and/or electronic tickets without departing from the scope of the present disclosure. An electronic ticket/voucher may be accepted by scanning a one-dimensional barcode, two dimensional barcode, or other type of barcode or quick response (QR) code displayed by a player's mobile device, for example. In one embodiment, an impersonal player ID may be present on the electronic ticket/voucher as part of the barcode, QR code, or other visible information on the electronic ticket/voucher.

The ticket issuance device 274 may be configured to print or provide physical tickets/vouchers to players. In some embodiments, the ticket issuance device 274 may be configured to issue a ticket/voucher consistent with an amount of credit available to a player, possibly as indicated within the credit meter 224.

The gaming device 108 may include at least one camera 278, or image capture device, that is configured to capture still and/or video images in proximity to the gaming device 108. The camera 278 may include, or be associated, with additional devices, such as light sources, flashes, infrared emitters, etc., to provide a clear image capture environment. As provided herein the camera 278 may be controlled by the processor 204 in conjunction with signals from the wagering instruction set 232 and/or other instruction sets in memory 208.

Figure 3A:
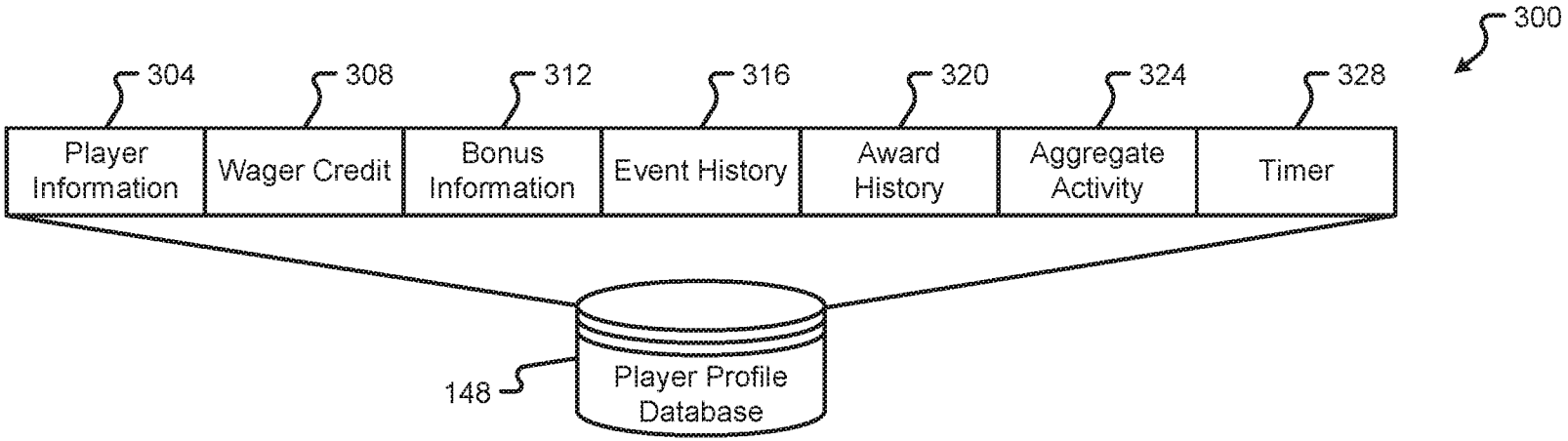
FIG. 3A is a block diagram depicting a first illustrative data structure used in accordance with embodiments of the present disclosure.
Figure 3B:
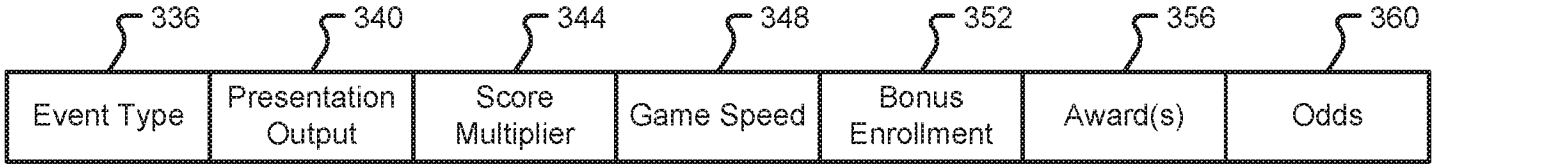
FIG. 3B is a block diagram depicting a second illustrative data structure used in accordance with embodiments of the present disclosure.

With reference now to FIGS. 3A and 3B, additional details of data structures that are useable in connection with managing player profiles and gaming behavior will be described in accordance with at least some embodiments of the present disclosure. It should be appreciated that the data structures depicted and described herein may be stored within a central database or may be distributed among a number of data storage nodes. Additionally or alternatively, some or all of the fields of the data structures may be maintained in devices of the gaming system 100 such as the gaming server 116, a betting system server 144, a gaming device 108, and/or a mobile device without departing from the scope of the present disclosure.

With reference initially to FIG. 3A, details of a data structure 300 that may be maintained as part of a player profile will be described in accordance with at least some embodiments of the present disclosure. The database 148 may be configured to store one or multiple data structures 300 that are used in connection with tracking player progress, wager history, and gaming activity. As a non-limiting example, the data structure 300 may be used to store wagers made, player history information, and the like. Even more specifically, the data structure 300 may include a plurality of data fields that include, for instance, player information field 304, a wager credit field 308, a bonus information field 312, an event history field 316, an award history field 320, an aggregate activity field 324, and a timer field 328.

The player information field 304 may be used to store any type of information that identifies a player or a group of players. In some embodiments, the player information field 304 may store one or more of username information for a player, password information for a player account, player status information, accommodations associated with the player, and any other type of customer service management data that may be stored with respect to a player.

The wager credit field 308 may be used to store data about a player's available credit with a casino, betting system, or a plurality of casinos. For instance, the wager credit field 308 may store an electronic record of available credit in the player's account and whether any restrictions are associated with such credit. The wager credit field 308 may further store information describing a player's available credit over time, cash out events for the player, winning events for the player, and the like.

The bonus information field 312 may be used to store information describing bonuses that have been paid to the player or that are available to be paid in response to particular events occurring within the gaming system 100. As a non-limiting example, the bonus information field 312 may be used to store electronic records for values of awards that are available to or have been paid to the player. Even more specifically, the bonus information field 312 may store values of awards that will be paid to the player if a particular event occurs within a predetermined amount of time (as monitored by a timer value in the timer field 328) and to store a value of an award that will be paid to the player if a plurality of events occur. In some embodiments, a value representing a predetermined award for a single event occurring may be less than a value representing a predetermined award for a plurality of events occurring. The bonus information field 312 may also be used to store probability information or odds associated with a particular event occurring or a plurality of events occurring. In some embodiments, the probability of a single event occurring within the gaming system 100 may be greater than a probability of a plurality of events occurring, regardless of whether or not the plurality of events include the single event.

The event history field 316 may be used to store historical data for events that occur with respect to the player. Any event or plurality of events having an associated probability of occurrence or award associated therewith (e.g., based on the event being defined within the bonus information field 312) may have a corresponding entry within the event history field 316. For instance, the event history field 316 may store a definition of events and whether or not a particular event belongs to a plurality of events eligible for a jackpot bonus as discussed herein. Each event defined within the event history field 316 may further include an associated indicator to show whether the event has occurred or not and, if the event has occurred, when the event occurred. Some particular, but non-limiting events, may include a player's outcome in a game of chance, a player's outcome in a game of skill, an outcome of a bet placed by the player at the gaming device 108, whether a player placed a bet at the gaming device 108, a player placing a particular bet, a celebration event for a person other than the player, a player's involvement in a celebration event, a player visiting a predetermined location, a player playing a particular game, a player interacting with their mobile device 216, etc.

The award history field 320 may store data related to awards, bonuses, mini bonuses, score multipliers, jackpots, etc. granted to the player. The award history field 320 may also indicate when such awards were granted to the player, whether the awards have been redeemed, whether the awards are being funded by a game of chance or skill, a bet placed on a competitive contest, a bet placed on an event associated with a competitive contest, a mini bonus associated with an event, or a jackpot award associated with the player completing a plurality of events.

The aggregate activity field 324 may also be used to store event information related to a plurality of events that are to occur if the player is to win a jackpot award or the like. Furthermore, the aggregate activity field 324 may store information related to wagers placed by a player (e.g., at the gaming device 108), wagers placed on competitive contests, wagers placed on an event associated with a competitive contest, wagers in connection with trying to complete the plurality of activities and whether any portions of such wagers are being used to fund a jackpot pool (e.g., parlay pool, progressive pool, mystery progressive, etc.), associated with other players competing in the same wagering event.

As discussed above, the timer field 328 may be used to store a timer value associated with tracking whether or not a particular player has won a wager on, or completed, a particular event or a plurality of events within a predetermined amount of time. The value of the timer within the timer field 328 may count up, count down, or increment in any known way to track a passage of time. Alternatively or additionally, time may be measured by an occurrence of events within the gaming system 100 rather than being measured absolutely. Specifically, the predetermined amount of time associated with determining whether a player has completed an event or a plurality of events before some other player within the system 100 has completed the same event or plurality of events. Thus, the timer does not necessarily have to count a passage of time with seconds and minutes, but rather may be counting a passage of time based on activities and events that occur within the system 100. Such information may be maintained within the timer field 328.

FIG. 3B shows details of another data structure 332 that may be used within the gaming system 100 in accordance with at least some embodiments of the present disclosure. In some embodiments, the event data structure 332 may be stored in the player profile database 148, the event database 160, or an internal memory of the gaming device 108 and/or the gaming server 116. In any event, the one or more event data structures 332 may be used in connection with providing a display and/or output presentation for a gaming device 108 based on an event associated with a competitive contest. In some embodiments, the data stored in the event data structure 332 may be stored for a plurality of different events, or event types. As a non-limiting example, the data structure 332 may be used to store an event type, a corresponding presentation output, and the like. Even more specifically, the data structure 332 may include a plurality of data fields that include, for instance, an event type field 336, a presentation output field 340, a score multiplier field 344, a game speed field 348, a bonus enrollment field 352, an award field 356, and an odds field 360. It should be appreciated that the data structure 332 may have greater or fewer fields than depicted in FIG. 3B.

The event type field 336 may be used to store an identification of a type of an event, or occurrence, associated with a competitive contest. The type of the event included in the event type field 336 may be used, for example, by the display presentation instruction set 228 to determine whether a particular presentation output or alteration is associated with an event that occurs in a competitive contest. The type of the event may indicate whether an event is a positive event (e.g., a score, a goal, a win, etc.) or a negative event (e.g., a penalty, injury, error, etc.) associated with a particular competitive contest. In some embodiments, the type of the event may be determined to be positive or negative based on a bet placed by a player. For example, although a penalty against a first team in a two-team competition may be considered a "negative" event for a player who bet on the first team, the penalty may be considered a "positive" event for another player who bet on the second team in the two-team competition. As provided above, event types may include, but are in no way limited to, scores, positions, plays, penalties, errors, injuries, calls, reviews, outcomes, results, times associated therewith, and/or the like. By way of example, an event type may correspond to a "holding penalty" called in an American football game competitive contest. In this example, the event data structure 332 may record the holding penalty, and based on the bet placed (e.g., on the holding team) by the player, an indication that the holding penalty is negative in the event type field 336.

The presentation output field 340 may be used to store a presentation output for the gaming device 108, and more specifically, for a casino game being played on the gaming device 108 based on the event type recorded in the event type field 336. The presentation output may include a specific display and/or sound presentation for the gaming device 108. Presentation outputs may include altering at least one color, animation, lighting, or other display output associated with a game played on the gaming device 108. The presentation output can change for a particular event type depending on whether the event type is positive or negative to a player who bet on the competitive contest with which the event is associated. A positive presentation output, associated with a positive event type for the player, may include providing pleasant sounds, colors, animations, and the like, via the display device 238, adding additional game play features, and the like. A negative presentation output, associated with a negative event type for the player, may include providing negative sounds, rendering dark colors, rendering blurred or obscured elements to the display screen 248 (e.g., in the form of 8-bit images, unclear images, etc.), preventing movement of game elements, altering a position of elements displayed, and the like. Continuing the "holding penalty" example above, the presentation output for a game played on the gaming device 108 may include "holding" portions of the game. For instance, if the game is a slots game, the display presentation instruction set 228 may determine to "hold," or prevent from moving, one or more reels of the slots game based on the presentation output recorded in the presentation output field 340. As can be appreciated, the presentation output may match a behavior that associated with a behavior in the competitive contest that led to the event type (e.g., the holding penalty, etc.).

The score multiplier field 344 may be used to store a game score multiplier to be applied to the casino game being played on the gaming device 108 based on the event type. One event type may be based on a performance over time for a competitive team or entity in the competitive contest. As the performance of the team/entity improves over time (e.g., a scoring run, a score streak, an increase in standing, etc.), the score multiplier for the casino game may increment positively and be applied to winnings in the casino game made by the player. Additionally or alternatively, as the performance of the team/entity declines over time (e.g., a number of penalties called against the team, being scored on by the opposing team/entity, a decrease in standing, etc.), the score multiplier for the casino game may decrement, negatively, and be applied to potential winnings in the casino game made by the player.

The game speed field 348 may be used to store a speed of play associated with the casino game being played on the gaming device 108. The faster an event occurs in the competitive contest, the faster the casino game may play on the gaming device 108. Additionally or alternatively, the slower an event occurs in the competitive contest, the slower the casino game may play on the gaming device 108. Similar to the score multiplier, the game speed may also be based on the performance of a team/entity over time. As the performance of the team/entity increases so does the game speed stored in the game speed field 348. As the performance of the team/entity decreases so does the game speed stored in the game speed field 348. In the event a user is playing a slots game at the gaming device 108, the reels may spin at faster or slower speeds, relative to a normal speed, based on the game speed in the game speed field 348. If the user is playing a card game at the gaming device 108, the cards in the game may be dealt faster or slower based on this game speed.

The bonus enrollment field 352 may be used to store information related to bonuses for which a particular event type qualifies a player. The bonus enrollment field 352 may define whether a player is able to enter a wager pool (e.g., parlay, progressive, mystery progressive, etc.), or become eligible to be enrolled in a bonus game, round, or jackpot. Similar to the other fields in the event data structure 332, the ability to be entered into a bonus, and the information stored in the bonus enrollment field 352, may depend on the event type stored in the event type field 336.

The awards field 356 may be used to store information about awards associated with a particular event type in a competitive contest. Awards may include monetary awards, credits, additional game play opportunities, prizes, tickets, and the like. The odds field 360 may be used to store odds information associated with the particular event type (e.g., stored in the event type field 336). The odds may be based on predicted advantages, disadvantages, outcomes, and/or other information received from a betting system server 144. In some embodiments, the greater the odds (e.g., 10:1, 50:1, 100:1, 1000:1, etc.) associated with a particular event type, the greater the rewards (e.g., enhanced presentation alteration/output, increased score multipliers, faster game speeds, better chances of being enrolled in bonus opportunities, greater awards, and/or the like), or vice versa.

With reference now to FIGS. 4A-4J, representative images of a display screen 248 of a gaming device 108 exhibiting various composite gaming presentations are shown in accordance with at least some embodiments of the present disclosure. Although shown as presenting a slots game, it should be appreciated that the display screen 248 of the gaming device 108 may render any casino game to the display area 400. In some embodiments, the display screen 248 may include a background configured to display a background image 402A, 402B, an interactive game window 404, a betting window 408, and an optional live video window 424. The display area 400 of the display screen 248 may be divided into separate, or discrete, areas or screen portions 406. It is an aspect of the present disclosure that the position of these areas may be moved, resized, minimized, superimposed, created, and/or removed, based at least on an event associated with a competitive contest the player has bet on. The interactive game window 404 may correspond to games that are provided by the gaming device 108 and/or the gaming server 116. The betting window 408 may include information received from the betting system server 144, betting database 152, and/or the gaming server 116.

Figure 4A:
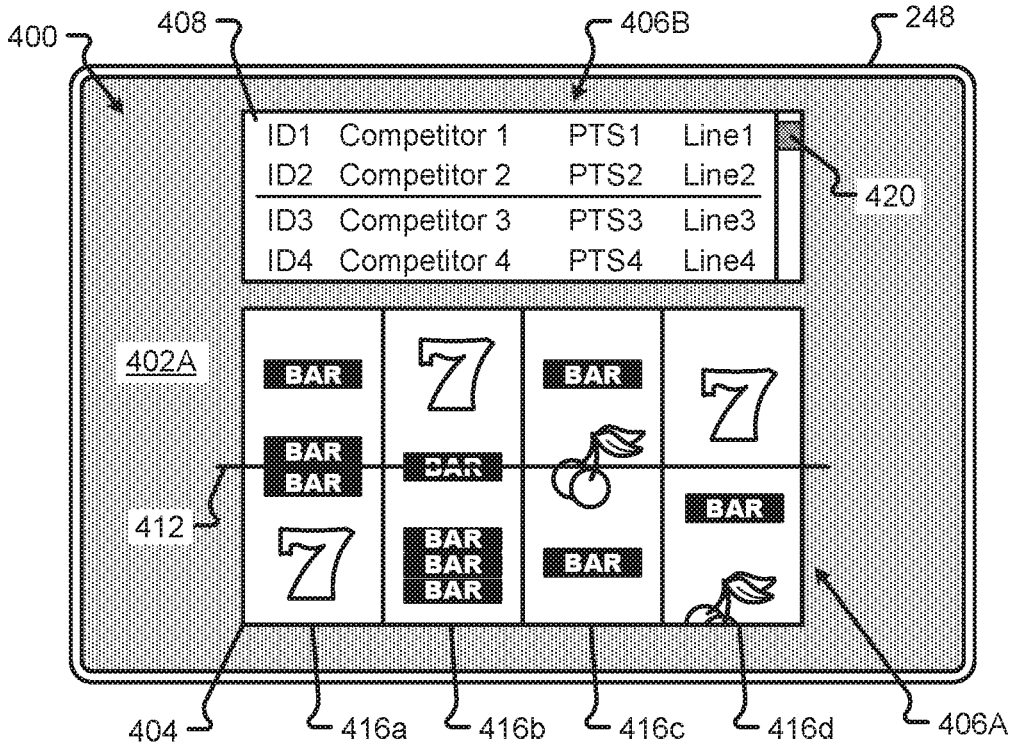
FIG. 4A is a representative image of a screen of a gaming device in a first composite gaming presentation in accordance with embodiments of the present disclosure.

FIG. 4A shows a representative image of a display screen 248 of a gaming device 108 in a first composite gaming presentation in accordance with embodiments of the present disclosure. The display screen 248 in the first composite gaming presentation includes a display area 400 configured to render an interactive game window 404 and a betting window 408 over a first background image 402A. In the first composite gaming presentation, the interactive game window 404 is rendered to a first portion 406A of the display area 400 and the betting window 408 is rendered to a second spanning portion 406B of the display area 400.

The interactive game window 404 may be configured to render any interactive casino game to the display screen 248. Examples of casino games that can be rendered to the interactive game window 404 may include, but are in no way limited to, poker, blackjack, craps, roulette, slots, bingo, keno, baccarat, dice games, and the like. As illustrated in FIGS. 4A-4J, a slots game is rendered to the interactive game window 404 comprising a number of reels 416 (each including a number of symbols or characters), and a payline 412 aligning with a portion of the reels 416. In the first composite gaming presentation shown in FIG. 4A, the interactive game window 404 is rendered to a first portion 406A of the display area 400. In some embodiments, the first portion 406A may correspond to a main display of the gaming device 108.

The betting window 408, in FIG. 4A, is shown rendered to a second spanning portion 406B of the display area 400. In particular, the second spanning portion 406B may correspond to a second portion of the display area 400 that spans across a length of the display area 400. The betting window 408 may include a number of betting opportunities in the form of a list or presentation of events and/or competitive contests on which a player may place a bet via the gaming device 108. For instance, a player may interact with the betting window 408 via a user interface 216 to select a particular betting opportunity rendered to the betting window 408. As shown in FIG. 4A, an example of a presentation including a number of competitors is shown grouped by competitive contests.

It is an aspect of the present disclosure that one or more portions 406A-406D or windows 404, 408, 424 in the display area 400 may include data that is generated by the gaming device 108 or data that is received over a specific communications ports 214*a*, 214*b* of the network interface 212. For example, content in first portion 406A may have data generated from the gaming device 108 itself or may present some data received over one port (e.g., first communications port 214*a*) of the network interface 212, whereas another portion 406B of the display area 400 may have data generated from a remote source and may be received over a different port (e.g., second communications port 214*b*). Additionally or alternatively, both portions 406A, 406B may have content received over the same network interface 212, but at different times and/or on different communication channels (even if received over the same port of the network interface 212).

As shown in FIG. 4A, the betting window 408 includes betting opportunities associated with Competitor 1, Competitor 2, Competitor 3, and Competitor 4. The betting opportunities, or options, for a player to bet on may include any number of events associated with a competitive contest. More betting options may be revealed by scrolling through the options, as indicated by the scroll indicator 420 displayed on a side of the betting window 408. The betting opportunities may be categorized by a unique identifier (e.g., ID1, ID2, ID3, ID4, etc.) and may even be grouped by contest. For example, the betting opportunities shown in FIG. 4A are grouped by contest, where Competitor 1 is shown as playing against Competitor 2 (e.g., being disposed on one side of a group indicator/line), and Competitor 3 is playing against Competitor 4 (e.g., being disposed on another side of the group indicator/line), etc.

In addition to basic information about betting opportunities, the betting window 408 may include additional information about each betting opportunity. For instance, the betting window 408 may include odds, betting lines, point spreads, and/or other wagering information. As illustrated in FIG. 4A, Competitor 1 is associated with a first point spread, PTS1, and a first betting line, Line 1, while Competitor 2 is associated with a second point spread, PTS2, and a second betting line, Line 2, and so on.

Figure 4B:
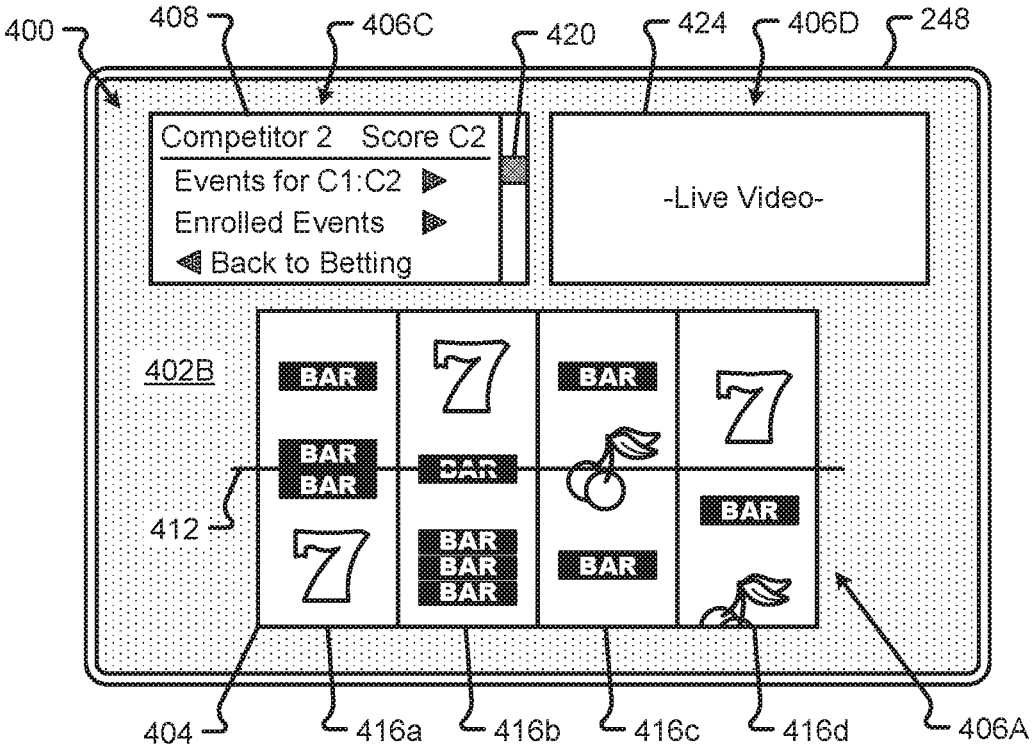
FIG. 4B is a representative image of a screen of a gaming device in a second composite gaming presentation in accordance with embodiments of the present disclosure.

Referring now to FIG. 4B, a representative image of a display screen 248 in a second composite gaming presentation is shown in accordance with embodiments of the present disclosure. In FIG. 4B, the player at the gaming device 108 has placed a bet on Competitor 2 by selecting the "ID2" line from the betting window 408 shown in FIG. 4A. This bet may be placed while the player is playing a game rendered to the interactive game window 404. The bet may be an in-game bet based on an event that Competitor 2 must perform. In some embodiments, the bet may be a bet on an outcome or occurrence of an event associated with the game that Competitor 2 is in. In the context of American football, a player may place a bet from the gaming device 108 that Competitor 2 will run the ball for more than five yards, etc. In any event, upon receiving the selection input provided by the player placing the bet, the gaming device 108 may send a signal comprising information defining the bet to the betting system server 144, where the bet is accepted and recorded for the player. This signal may be sent directly by the gaming device 108 and/or via the gaming server 116 across the communication network 104 to the betting system server 144. As provided above, this recording of the bet placed may be stored and associated with the player in the player information data structure 300.

In response to placing the bet, the gaming device 108 may determine to alter the background and/or other presentation of information rendered by the display screen 248 based on the bet placed. For example, and as shown in FIG. 4B, the first background image 402A has been changed to a second background image 402B. In some embodiments, the second background image 402B may correspond to a background image associated with the contest, competitor, or a combination thereof associated with the selection made by the player. In FIG. 4B, the second background image 402B may correspond to a background image that corresponds to Competitor 2. In some embodiments, the second background image 402B may be a still image, a moving image, or a series of animated images.

It is an aspect of the present disclosure that the gaming device 108 may render a live video window 424 for the competitive contest associated with the bet placed by the player to a third portion 406D of the display area 400. The live video window 424 may stream live video about the competitive contest (e.g., a live football game, a live race, a basketball game, a baseball game, etc.) in real-time or in near-real-time (e.g., as the competitive contest is underway or being played). In one embodiment, the betting window 408 may change position (e.g., to accommodate the live video window 424, etc.) from the second spanning portion 406B to a smaller, or repositioned, second portion 406C of the display area 400.

The betting window 408 may include information pertinent to the competitive contest or external event in which the player placed a bet. This information may include a current score, events associated with the competitive contest that the player enrolled in, and/or other events associated with the competitive contest that are available for the player to bet on. In some embodiments, the betting window 408 may include an option for the player to navigate back to the betting screen, for example, to bet on other competitive contests.

In some embodiments, the aspect ratios for various image content rendered to one or more portions of the display area 400 may be based on the size of the display area and/or the relative size of the portions 406A-406D. In one embodiment, when the content associated with a particular window 404, 408, 424 moves from portion 406A-406D to another, the aspect ratio associated with the content may change accordingly (e.g., based on the aspect ratio, size, area, and/or other dimension or shape of the window displayed in a portion of the display area 400).

Figure 4C:
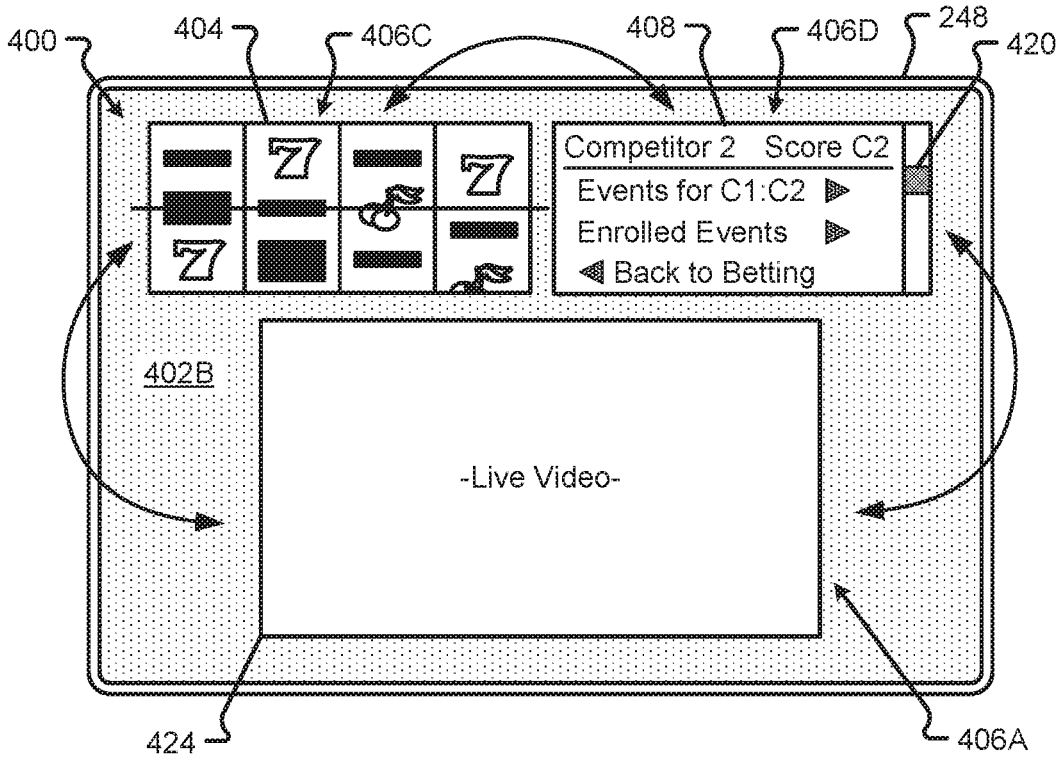
FIG. 4C is a representative image of a screen of a gaming device in a third composite gaming presentation in accordance with embodiments of the present disclosure.

FIG. 4C is a representative image of a display screen 248 of a gaming device 108 in a third composite gaming presentation in accordance with embodiments of the present disclosure. In this presentation, a position of one or more of the windows 404, 408, 424 rendered to the display area 400 may change position, size, and/or shape. For instance, the interactive game window 404 is shown as being moved from the first portion 406A to the second portion 406C, the betting window 408 is shown as being moved from the second portion 406C to the third portion 406D, and the live video window 424 is shown as being moved from the third portion 406D to the first portion 406A of the display area 400. In one embodiment, the movement from one portion to another, for any window, may be accompanied by an animated transition showing the gradual movement of each window from one position of the display area 400 to another position of the display area 400.

In some embodiments, the movement of windows 404, 408, 424 may be triggered automatically based on an event associated with the competitive contest, manually based on a position change request input provided by the player, automatically based on a pause in play associated with the interactive game rendered to the interactive game window 404, and/or in response to one or more other conditions. In one embodiment, the live video window 424 may be moved to a portion of the display area 400 having the greatest display area to show an instant replay, highlight a scoring opportunity, show a photo-finish, and the like.

Figure 4D:
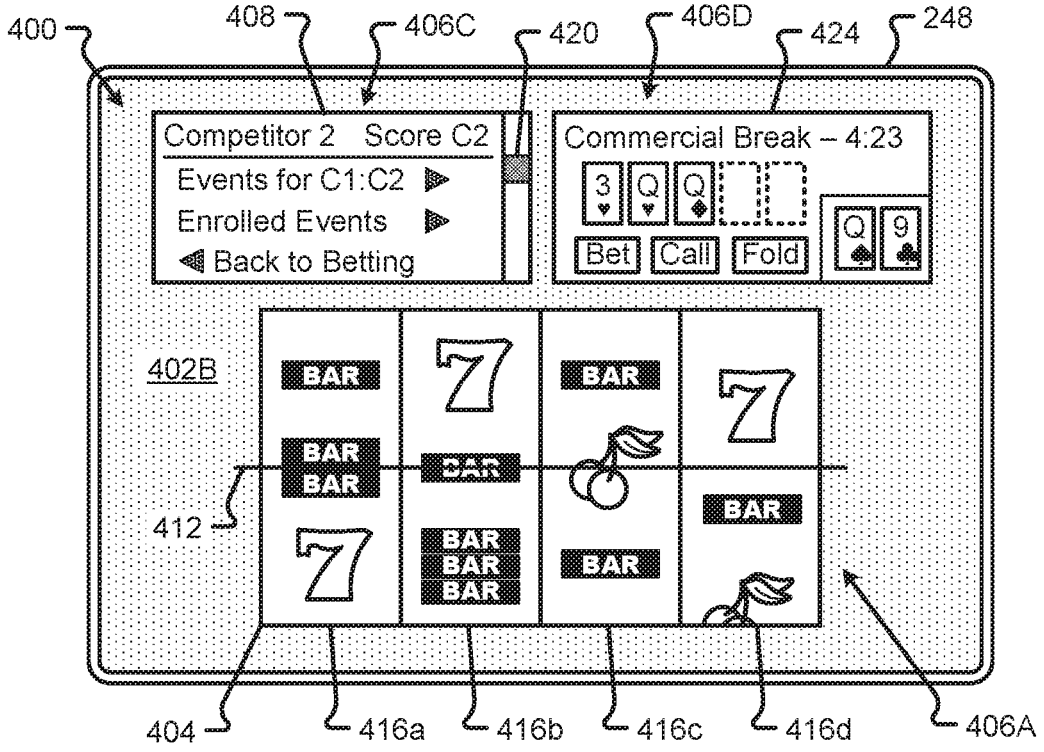
FIG. 4D is a representative image of a screen of a gaming device in a fourth composite gaming presentation in accordance with embodiments of the present disclosure.

In FIG. 4D, the live video window 424 may transition from one presentation of information to another based on an event in the competitive contest. If the event has concluded, if there is a break in coverage (e.g., timeout, commercial break, half-time, penalty, foul, etc.), or if the live video feed is paused for some other reason, the live video window 424 may be configured to render a new game or other information to a player. As shown in FIG. 4D, the competitive contest may be at a commercial break. In this example, a length of the commercial break remaining may be listed (e.g., four minutes and twenty-three seconds left before the game returns, etc.) and a temporary, bonus, or side game may be available to play via the live video window 424. A side game of "Texas Hold'em" is shown in the live video window 424 of FIG. 4D, allowing the player to simultaneously play the game in the interactive game window 404 and the live video window 424. The side game may allow a player to play the side game, while the external event is at a break, and allow the player to earn additional points beyond what may be available via the game rendered to the interactive game window 404. The side game may provide interactive elements that allow the player to bet, call, fold, or otherwise control the side game from the live video window 424. When the competitive contest returns from the commercial break, the player may be provided an opportunity to continue the side game via the live video window 424, pause the side game, or switch to watching the competitive contest via the live video window 424. In some embodiments, the live video window 424 may provide a split-screen allowing the player to continue to play the side game while watching the live video of the competitive contest. This split-screen may include movement of the live video window 424 from the third portion 406D to the first portion 406A, and movement of the other windows 404, 408 accordingly. In one embodiment, the live video of the competitive contest may be moved to a position behind, or at least partially behind, the interactive game window 404, such that the interactive game window 404 is superimposed over at least a portion of the live video of the competitive contest. In some embodiments, the live video window 424 may fill an area associated with the background (e.g., first background image 402A, second background image 402B, etc.).

Figure 4E:
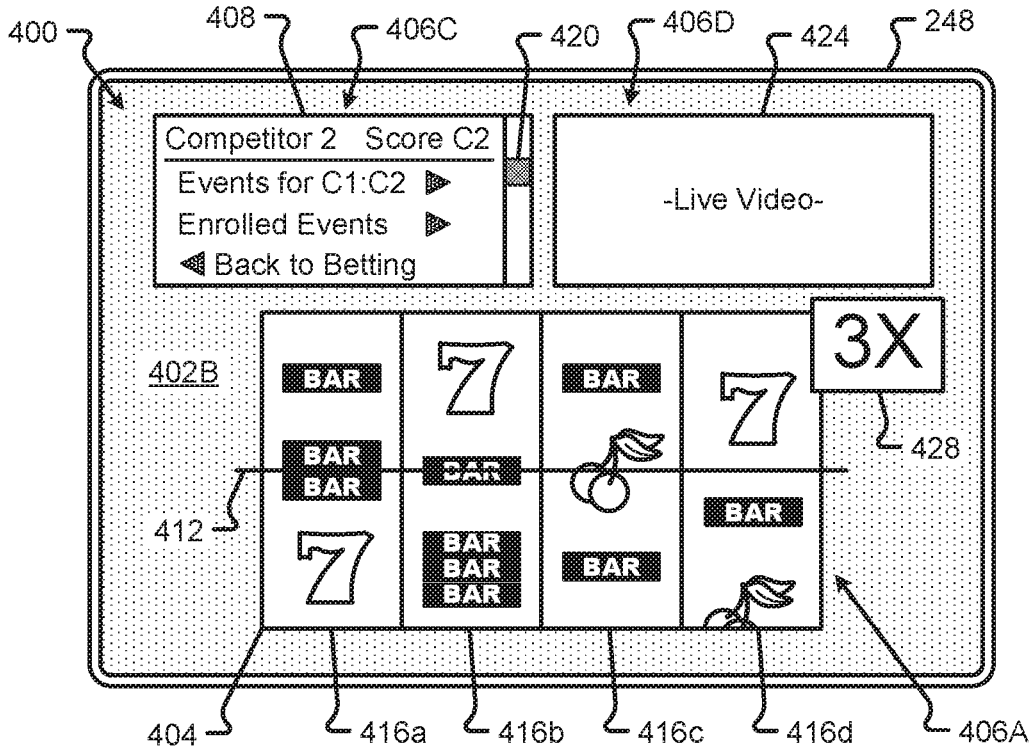
FIG. 4E is a representative image of a screen of a gaming device in a fifth composite gaming presentation in accordance with embodiments of the present disclosure.
Figure 4F:
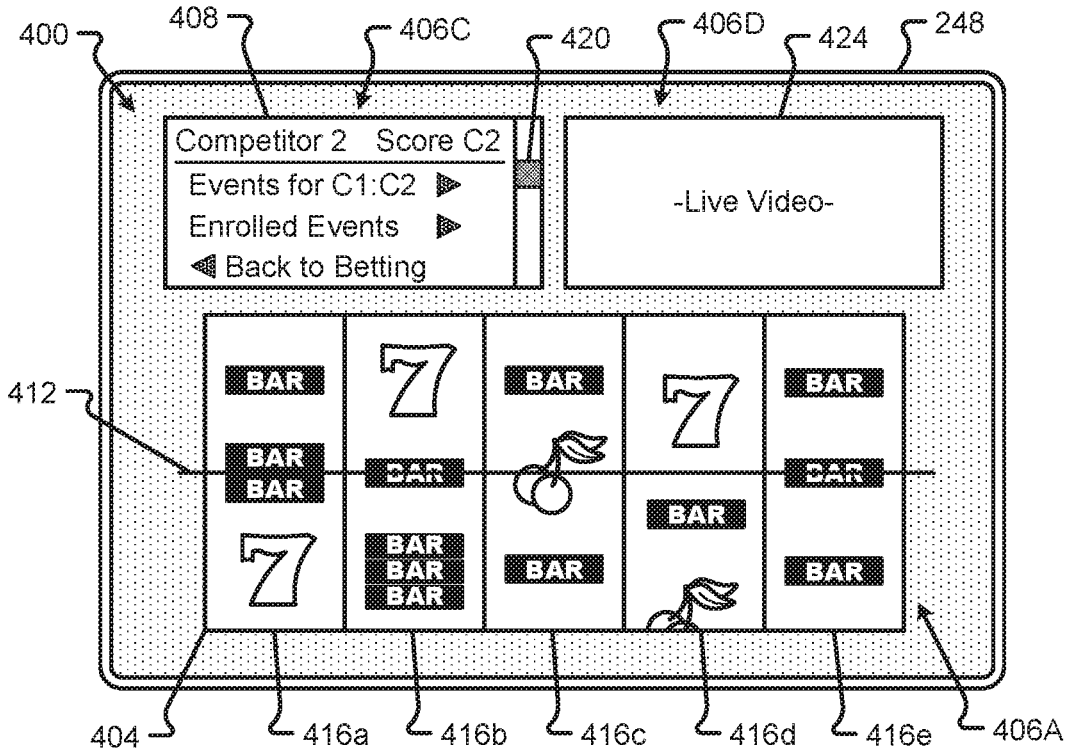
FIG. 4F is a representative image of a screen of a gaming device in a sixth composite gaming presentation in accordance with embodiments of the present disclosure.

As provided above, events associated with the competitive contest may be deemed "positive" or "negative" to a player based on whether the event has the potential of positively or negatively affecting a bet placed by the player. FIGS. 4E and 4F show examples of "positive" presentation outputs in response to an event associated with a competitive contest determined to be positive for a player.

For example, FIG. 4E shows a score multiplier indicator 428 that is associated with the game played in the interactive game window 404. The score multiplier shown in the score multiplier indicator 428, or applied to the game played in the interactive game window 404, may correspond to the score multiplier stored in the score multiplier field 344 for a particular event associated with a competitive contest. The score multiplier may affect payouts from the game played in the interactive game window 404. For example, a score multiplier of 3× may triple the payouts associated with the payline 412 shown in the slots game rendered to the interactive game window 404 of the gaming device 108.

FIG. 4F shows another example of a positive presentation output for a game played in the interactive game window 404. Similar to the score multiplier described in conjunction with FIG. 4E, the presentation output of FIG. 4F is based on a positive event associated with the competitive contest the player bet on. In FIG. 4F, the presentation output alteration may include adding an additional reel (e.g., fifth reel 416*e*) to the slots game having first, second, third, and fourth reels 416*a*, 416*b*, 416*c*, 416*d*. As can be appreciated, the addition of the fifth reel 416*e* increases the player's chance to win at the casino game of the gaming device 108. In some embodiments, the presentation output alteration of adding a reel to the slots game may be stored in the presentation output field 340 of the event data structure 332.

Figure 4G:
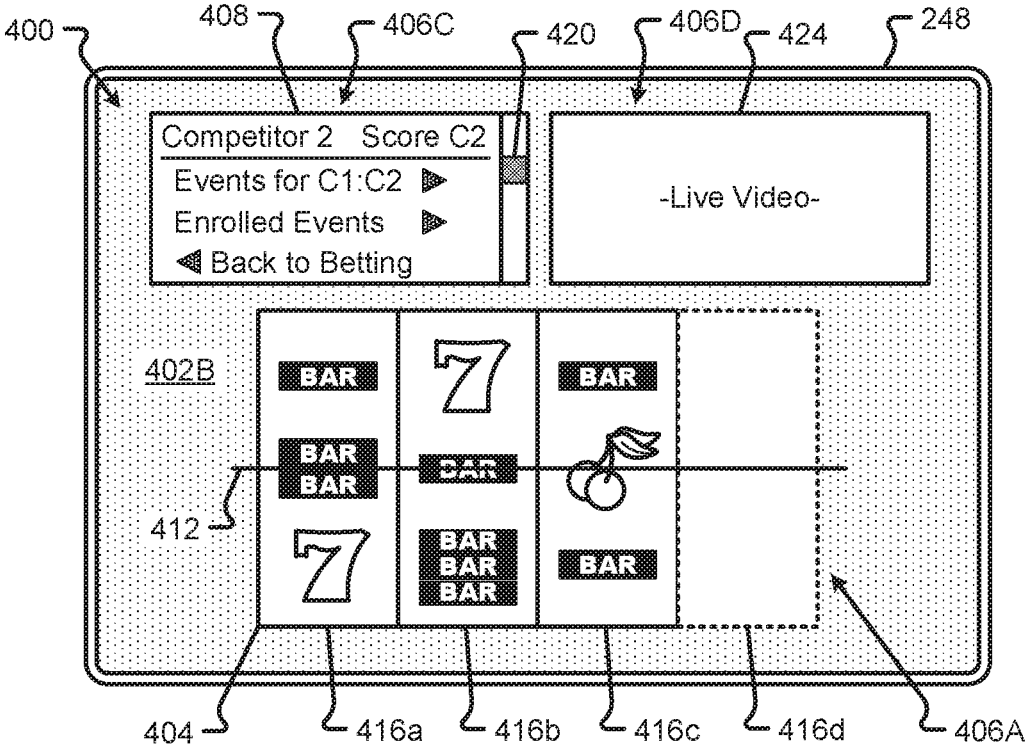
FIG. 4G is a schematic diagram of a screen of a gaming device in a seventh composite gaming presentation in accordance with embodiments of the present disclosure.
Figure 4H:
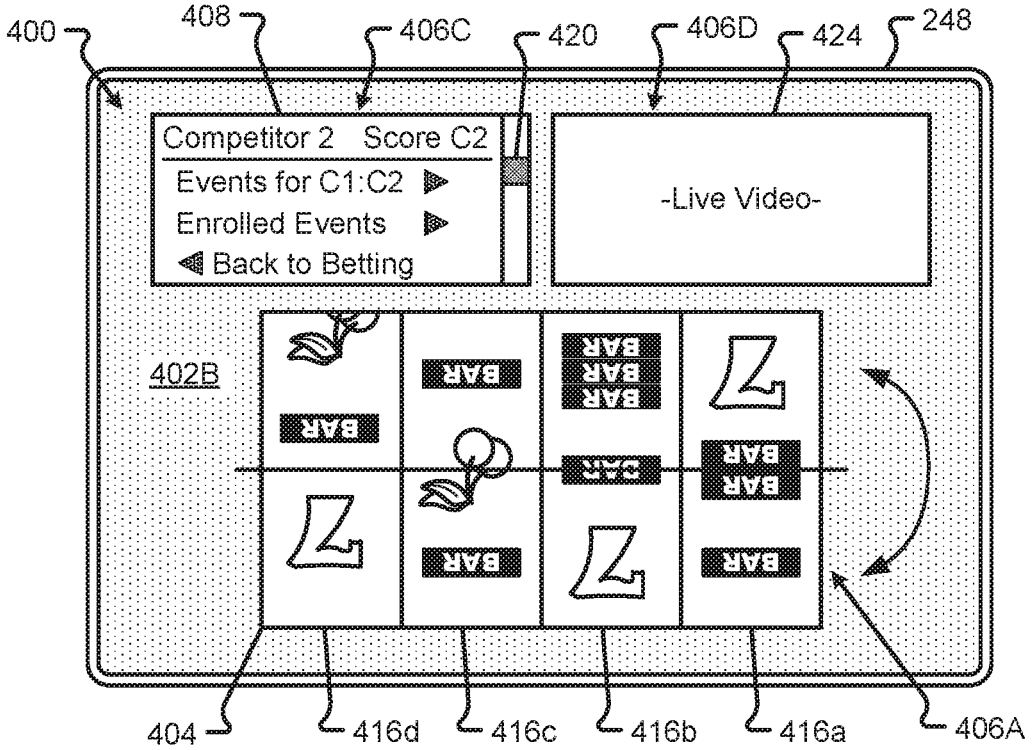
FIG. 4H is a schematic diagram of a screen of a gaming device in a eighth composite gaming presentation in accordance with embodiments of the present disclosure.

FIGS. 4G and 4H show examples of "negative" presentation outputs in response to an event associated with a competitive contest that are determined to be negative for a player.

Referring to FIG. 4G a negative presentation output may include altering a portion of the game rendered to the interactive game window 404 to remove an element from the game. As shown in FIG. 4G, the fourth reel 416*d* of the slots game has been removed from being played. In some cases, the fourth reel 416*d* may be removed in response to determining that a player has been ejected from a team in the competitive contest the player has bet on. In one embodiment, the fourth reel 416*d* may be removed in response to determining that a football team the player bet on is assessed a 15-yard penalty. Other events may cause the removal of reel 416*d* from the reels 416 rendered in the interactive game window 404. In some embodiments, the presentation output alteration of removing a reel from the slots game may be stored in the presentation output field 340 of the event data structure 332.

Yet another negative presentation output for the display screen 248 is shown in conjunction with FIG. 4H. As shown in FIG. 4H, the reels 416 of the slots game rendered in the interactive game window 404 have been turned upside-down, or inverted. In some embodiments, the reels 416 may be inverted in response to determining that a team has fumbled the ball in a competitive contest the player has bet on. In one embodiment, the reels 416 may be caused to spin backwards, out-of-order, or erratically. These behaviors of the reels 416 may be caused by any number of events determined to be potentially negative to the bet placed by the player, or determined as a negative outcome for the team/entity bet on by the player. This presentation output alteration of affecting a behavior, orientation, or animation of a reel from the slots game may be stored in the presentation output field 340 of the event data structure 332.

Figure 4I:
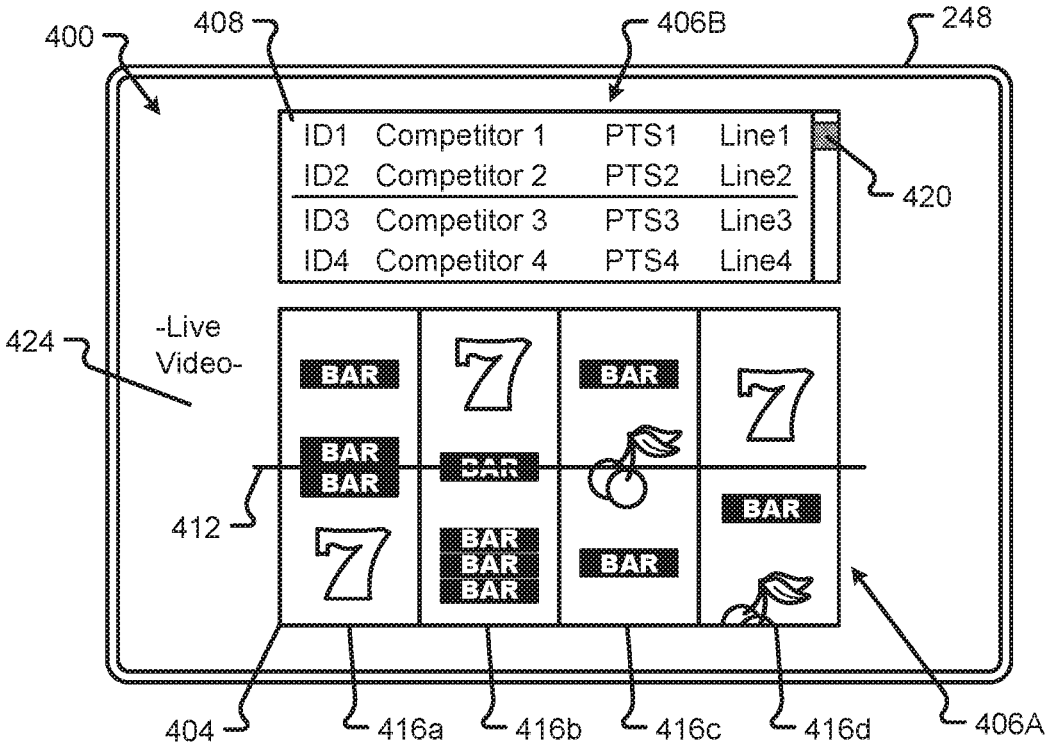
FIG. 4I is a schematic diagram of a screen of a gaming device in a ninth composite gaming presentation in accordance with embodiments of the present disclosure.
Figure 4J:
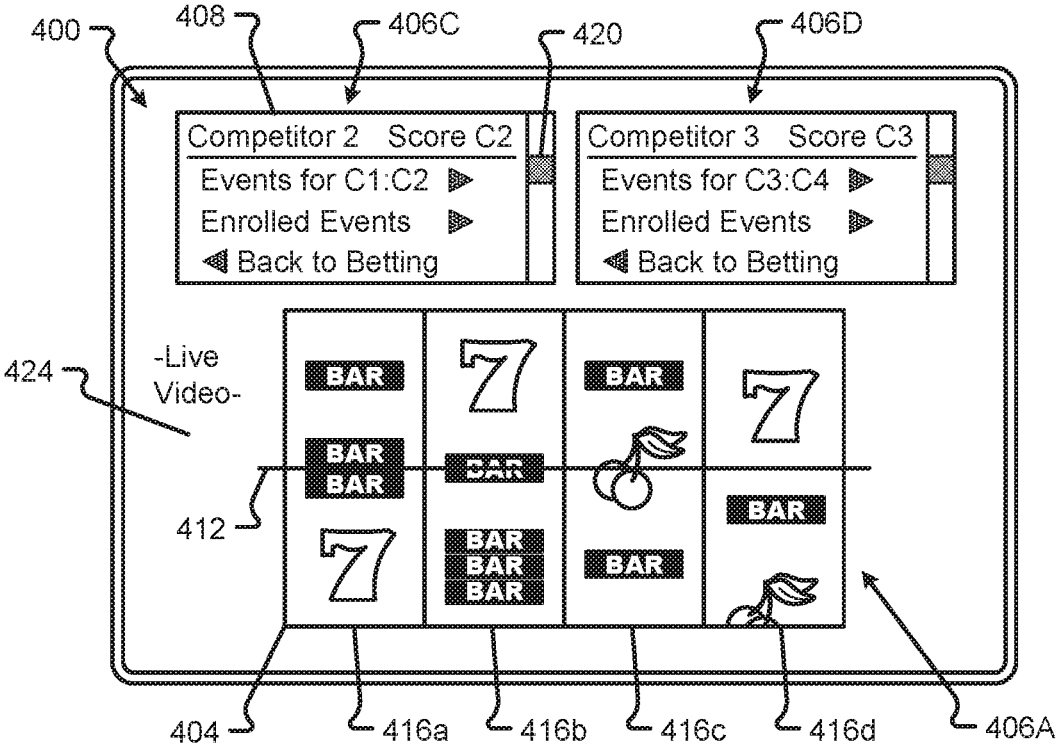
FIG. 4J is a schematic diagram of a screen of a gaming device in a tenth composite gaming presentation in accordance with embodiments of the present disclosure.

FIGS. 4I and 4J show examples of a live video presentation associated with a competitive contest rendered to a background or portion of the display area 400 of the display screen 248 including superimposed windows 404, 408.

As shown in FIG. 4I, the live video window 424 is rendered behind the interactive game window 404 and the betting window 408 rendered to the display area 400 of the display screen 248. In some embodiments, the interactive game rendered to the interactive game window 404 may be played on top of the live video playing behind the interactive game window 404. In one embodiment, the interactive game window 404 and/or elements rendered in the interactive game window 404 may be at least partially translucent or transparent to allow at least some of the live video to be viewed behind the interactive game elements (e.g., payline 412, reels 416, symbols, etc.).

FIG. 4J shows a second betting window rendered to the third portion 406D of the display area 400. Similar to FIG. 4I, the live video associated with the competitive contest rendered in the live video window 424 may be displayed behind, or at least partially behind, one or more of the other windows 404, 408, etc., rendered to the display area 400. In some embodiments, the second betting window may be the similar to, or the same as, the betting window 408. However, the second betting window may allow the player of the gaming device 108 to place bets on other competitive contests, in some cases, different from those shown in the betting window 408.

In some embodiments, the position of the live video may switch from a position rendered behind the other windows 404, 408, etc. in the display area 400 to a position at least partially in front of the other windows 404, 408. This switch may be triggered based on an event in the competitive contest, a break in interactive gaming play, and/or an input provided by the player at the gaming device 108. In one embodiment, the live video window 424, when disposed in front of the other windows 404, 408, etc., may be at least partially translucent or transparent to allow at least some of the other windows 404, 408, etc. to be visible therethough.

Figure 5:
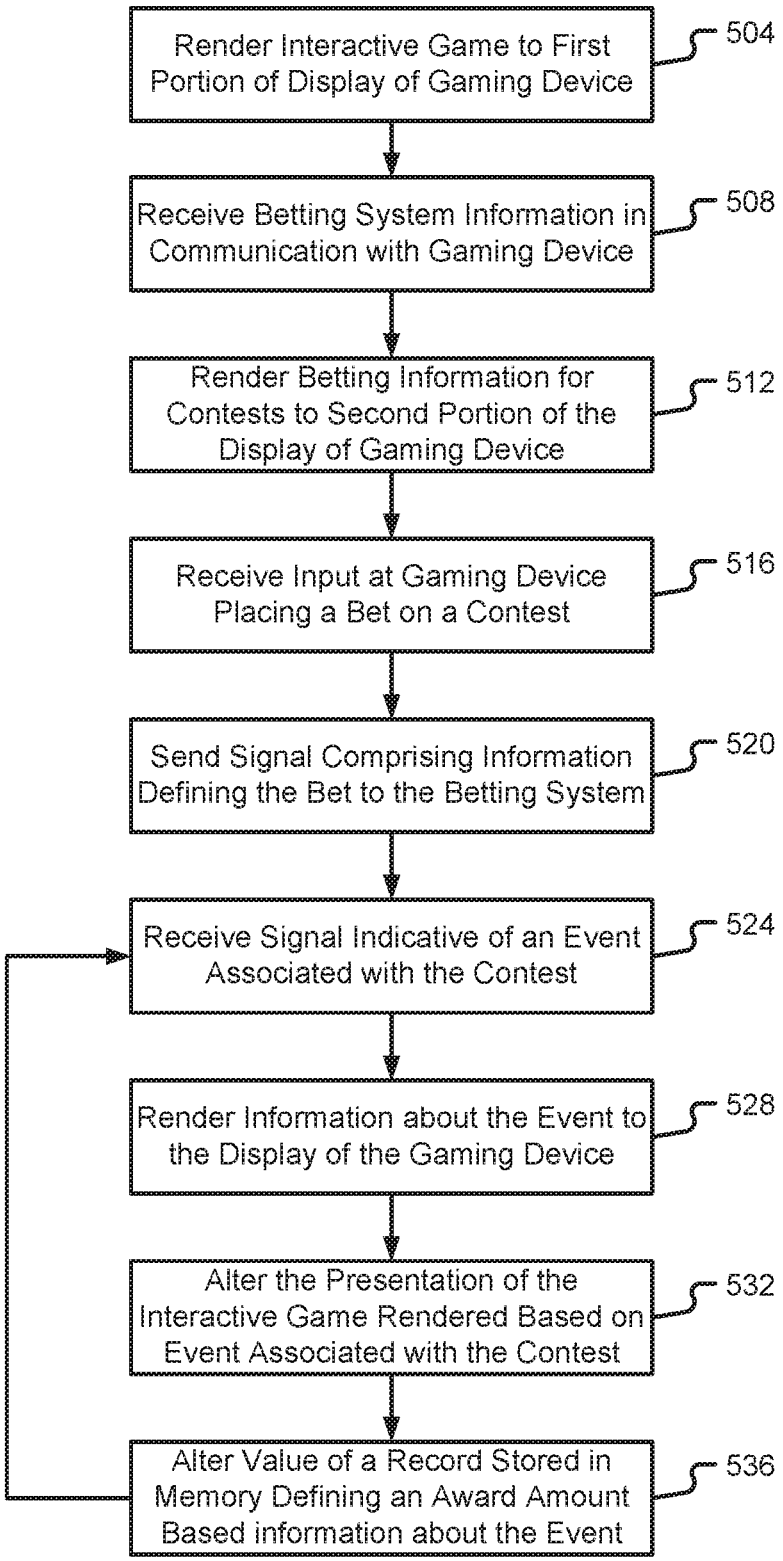
FIG. 5 is a flow diagram depicting a method of placing bets at a gaming device in accordance with embodiments of the present disclosure.

With reference now to FIG. 5, a flow diagram depicting a method of placing bets at a gaming device 108 is shown in accordance with embodiments of the present disclosure. The method begins by rendering an interactive game to a first portion of a display screen 248 of a gaming device 108 (step 504). As described herein the gaming device 108 is a single machine, or terminal, that includes both casino gaming functionality as well as sports/race betting functionality. The casino games that can be rendered to the first portion of the display device may include, but are in no way limited to, poker, blackjack, craps, roulette, slots, bingo, keno, baccarat, dice games, and the like. A player may interact with the game via one or more user interface devices, buttons, keyboards, handles, joysticks, and/or touchscreens (e.g., user interface 216 devices, etc.).

The method continues by receiving betting information from a betting system (e.g., a betting system server 144), that is in communication with the gaming device 108 (step 508). In some embodiments, the gaming device 108 may receive betting information from the betting system server 144 by way of the gaming server 116. In other words, the gaming server 116 may compile the betting information from the betting system server 144 and may present the betting information in accordance with formatting and rules associated with the gaming server 116 or the gaming system 100. The betting information may include a plurality of betting opportunities associated with competitive contests. These betting opportunities may include any event associated with the competitive contests. The betting information may include wagering odds, lines, point spreads, ranks, and the like.

The information from the betting system may be rendered to a second portion of the display screen 248 of the gaming device 108 (step 512). The information may be presented in a list format, group format, images, or other display presentations. In some embodiments, the second portion of the display screen 248 may be a secondary screen or secondary display device.

The method continues by receiving an input at the gaming device 108 corresponding to a user placing a bet on a particular competitive contest (step 516). The input may be provided via the one or more user interface 216 devices. In some embodiments, the input may be made by a player interacting with the betting information rendered to the second portion of the display screen 248 of the gaming device 108, as described in conjunction with steps 508 and 512. For instance, the player may select a line corresponding to a specific betting opportunity and place a bet therefrom. In one embodiment, the player may place bets at the gaming device 108 while playing a game on the gaming device 108.

The method continues by sending a signal comprising information defining the bet placed by the player to the betting system (step 520). In some embodiments, the signal may be sent directly by the gaming device 108 to the betting system server 144 across the gaming system 104. In one embodiment, the signal may be sent from the gaming device 108 to the gaming server 116, and then the gaming server 116 may send the signal to the betting system server 144. In any event, the gaming server 116 may update the player information data structure 300 to reflect the bet made by the player.

The method continues by receiving a signal indicative of an event associated with the competitive contest the player bet on (step 524). The signal may be sent by the betting system server 144 and/or the gaming server 116. The event associated with the competitive contest may correspond to any occurrence that happens in the competitive contest or that is related to bets on occurrences in the competitive contest. Information about the event may be rendered to the display screen 248 of the gaming device 108 (step 528). This information may include a text message, display output, sound output, score change, ranking change, or other audible/visual presentation of information.

The method continues by altering the presentation of the game (e.g., the casino game) played on the gaming device 108 by the player who placed the bet (step 532). Altering the presentation of the game may include altering a display or auditory presentation of game information. In addition to a change in information rendered to the display, the presentation alteration may alter a behavior, score multiplier, speed, and/or other aspect of the casino game being played at the gaming device 108. The presentation alteration may correspond to one or more of the composite gaming presentations described in conjunction with FIGS. 4A-4J.

In some embodiments, the method continues by altering a value of a record stored in memory defining an award amount based on the information about the event (step 536). The record may correspond to the amount stored in a credit meter 224, or a cash-out amount associated with an issued ticket/voucher. The award amount may correspond to a combination of the winnings in a game played on the gaming device 108 and the event associated with the competitive contest. The method may continue and repeat by returning to step 524 and receiving additional signals indicative of other events associated with the competitive contest.

Figure 6:
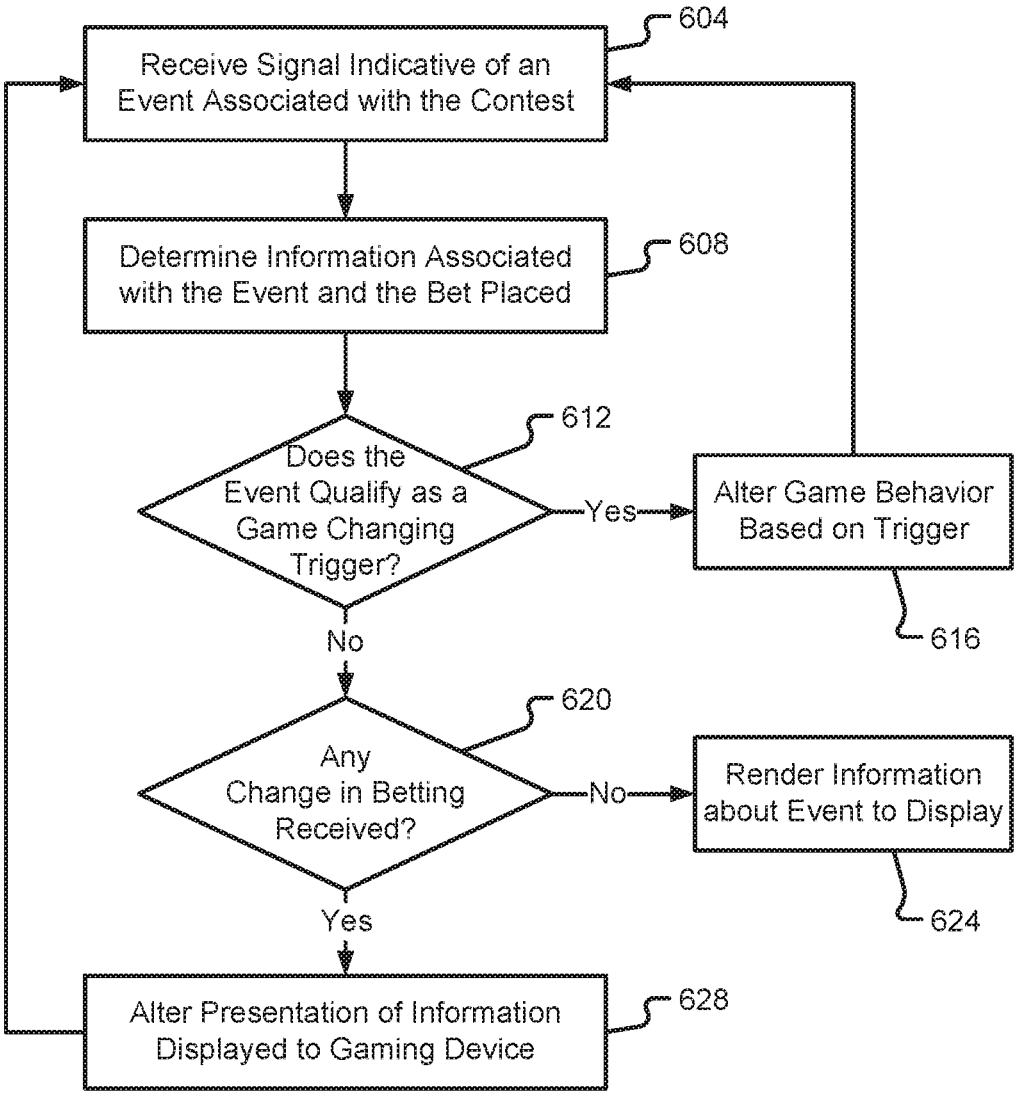
FIG. 6 is a flow diagram depicting a method of altering a display presentation of a gaming device in accordance with embodiments of the present disclosure.

FIG. 6 is a flow diagram depicting a method of altering a display presentation of a gaming device 108 in accordance with at least some embodiments of the present disclosure. The method begins by receiving a signal indicative of an event associated with the competitive contest. In particular, the event is associated with the competitive contest for which the player placed a bet. In some embodiments, this step may be the same or similar to step 524 described in conjunction with the method illustrated in FIG. 5. It is an aspect of the present disclosure that the method of altering a display presentation of a gaming device 108 described in conjunction with FIG. 6 may be further, or additional, steps of the method of FIG. 5.

The method continues by determining information associated with the event and the bet placed by the player (step 608). The information associated with the event may be the same as, or similar to, the information stored in the event data structure 332 of FIG. 3B. For instance, the information may define an event type, a presentation output for the event type, game behaviors for the event, wagering information, score multipliers, and the like. In some embodiments, the information associated with the event may be stored by an event data server 156 and/or the gaming server 116.

The method continues by determining, based on the information about the event, whether the event qualifies as a game changing trigger (step 612). The game changing trigger may correspond to a trigger that prompts a presentation output change to the casino game being played by the player on the gaming device 108. In some cases, events may not require any change to a presentation output of a game played on the gaming device 108. For example, an event in a competitive contest may include an action or occurrence that is neither beneficial (e.g., positive) nor detrimental (e.g., negative) to a player, the player's bet, or an outcome of the competitive contest. A person running onto the field at a football game, while definitely qualifying as an event, may not qualify as a game changing trigger. Additionally or alternatively, a rain delay at a competitive contest may constitute an event, but may not quality as a game changing trigger for the game played by the player at the gaming device 108. In short, a qualifying game changing trigger may correspond to an event that affects a player's bet on the competitive contest or is defined as a trigger by the display presentation instruction set 228.

Although the previous examples of a person running onto the field, and a rain delay, may not be considered game changing triggers, it should be appreciated that these events could be used to change a display output to the display screen 248. For example, an image of person running across the display area 400 of the display screen 248 could be rendered upon determining that a person ran onto the field in the competitive contest. As another example, an image of rain may be caused to be rendered in the display area 400 of the display screen 248 in response to determining that a rain delay was called in the competitive contest.

If the event is determined to be a game changing trigger, the method may continue by altering the game behavior (e.g., score multipliers, speed, awards, enrollment in wager pools, etc.) based on the event and the trigger (step 616). The game behavior alteration may include a presentation output or alteration as shown in one or more of the composite gaming presentations described in conjunction with FIGS. 4A-4J.

If the event is not determined to be a game changing trigger, the method may continue by determining if there is any change in betting received (step 620). A change in betting may include the player selecting a new team/entity in the competitive contest to bet on, betting on a new competitive contest, increasing a bet on an existing team/entity bet on in a competitive contest, and/or betting on multiple teams/entities in a competitive contest. If no change to the betting is received, the gaming device 108 may render information about the event to the display screen 248, which may be similar, if not identical, to step 528 described in conjunction with FIG. 5.

When a change in the betting information is received, the gaming device 108 or the gaming server 116 may determine to alter a presentation of information displayed by the display screen 248 of the gaming device 108. In some embodiments, this step may be the same or similar to step 532 described in conjunction with FIG. 5. The altered presentation may include changing colors, background images, and or other elements displayed to the display screen 248 to match the event and the bet placed.

Figure 7:
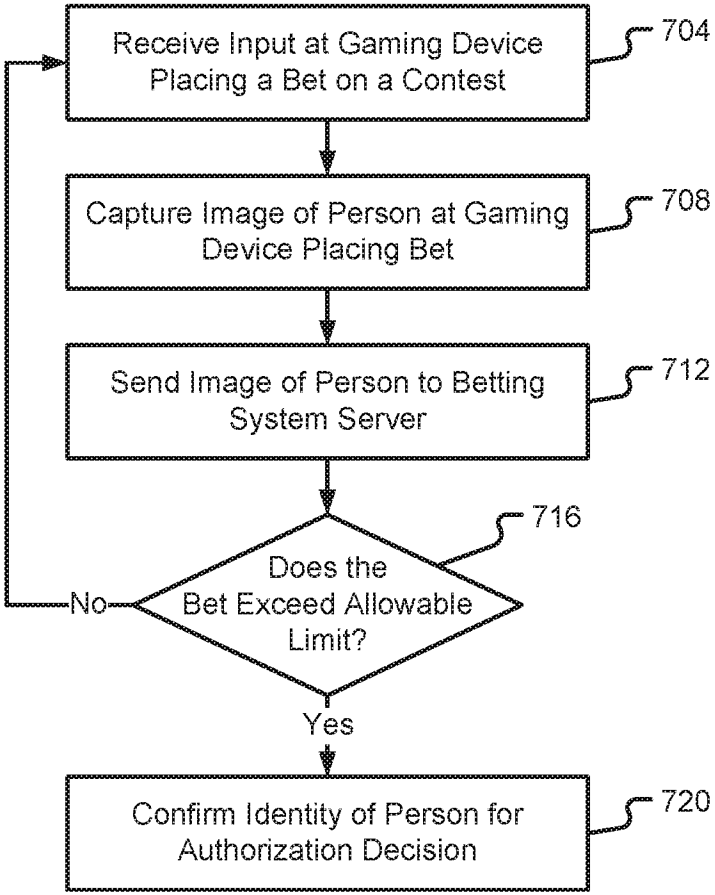
FIG. 7 is a flow diagram depicting a method of authorizing bets based on identity in accordance with embodiments of the present disclosure.

With reference to FIG. 7, a flow diagram depicting a method of authorizing bets based on an identity of a player is shown in accordance with at least some embodiments of the present disclosure. The method may proceed upon receiving input at a gaming device 108 corresponding to a player attempting to place a bet on at least one competitive contest (step 704). In some embodiments, this step may be the same or similar to step 516 described in conjunction with FIG. 5. In one embodiment, the method may continue by verifying whether the player is allowed to place the bet. This verification may include determining an age of the player, whether the player has exceeded any gambling limits, and/or is otherwise restricted from placing the bet.

The method continues by capturing an image of the player at the gaming device 108 who is attempting to place the bet (step 708). In some embodiments, the wagering instruction set 232, when executed by the processor 204 of the gaming device 108, may determine that verification is required. In this case, the wagering instruction set 232 may include instructions that command one or more cameras 278 of gaming device 108 to obtain image data for the player at the gaming device 108.

The method continues by sending the image of the player from the gaming device 108 to the gaming server 116 and/or the betting system server 144 (step 712). The image of the player may be sent along with information about the bet to be placed. In some embodiments, the gaming server 116 and/or the betting system server 144 may determine whether the bet exceeds an allowable limit for the player. For instance, certain regulations may require that the gaming device 108 limit a single person to betting no more than $10,000 in one day. If the bet exceeds the allowable limit, based on the identification of the player and past bets placed by the player (e.g., retrieved by the gaming server 116 from the player information data structure 300, etc.), the method may continue by confirming the identity of the player before an authorization decision can be made. In some embodiments, the gaming server 116 may dispatch an attendant to a particular gaming device 108 to verify the identity of the player and the attempted bet. Once the identity is confirmed by the attendant, the attendant may send, via a communication device, a signal to the gaming server 116 and/or the betting system server 144 authorizing or denying the bet attempt.

Figure 8:
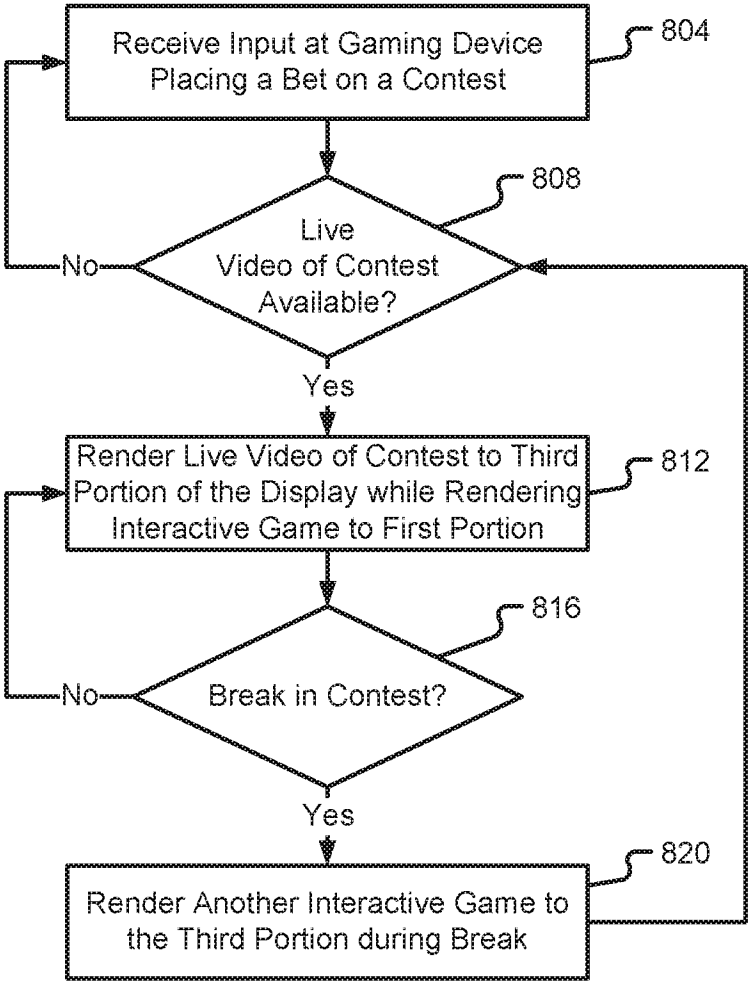
FIG. 8 is a flow diagram depicting a method of rendering a live video of a contest associated with a bet made at a gaming device in accordance with embodiments of the present disclosure.

FIG. 8 is a flow diagram depicting a method of rendering a live video of a contest associated with a bet made at a gaming device 108 in accordance with at least some embodiments of the present disclosure. The method begins by receiving input at a gaming device 108 corresponding to a player attempting to place a bet on at least one competitive contest (step 804). In some embodiments, this step may be the same or similar to step 516 described in conjunction with FIG. 5.

The method continues by the gaming device 108 or the gaming server 116 determining whether a live video feed of the competitive contest is available to be rendered to the display device 238 of the gaming device 108 (step 808). In some embodiments, this step may include the gaming device 108 or the gaming server 116 determining whether a live video feed exists and whether the live video feed is subject to any license agreements restricting play in a given region or to a particular audience. If the live video is determined to be available, a connection between the gaming device 108 and a contest video server 164 may be established.

The method continues by rendering live video of the competitive contest to a portion of the display screen 248 while simultaneously rendering an interactive game to the display screen 248 of the gaming device 108 (step 812). In some embodiments, the competitive contest may be rendered to a different portion of the display screen 248 than the portion of the display screen 248 rendering the casino game. In one embodiment, the live video of the competitive contest may be rendered behind, or at least partially behind one or more windows 404, 408 rendered in the display area 400. Examples of the live video presentation and simultaneous rendering by the display screen 248 of the gaming device 108 are illustrated in conjunction with FIGS. 4B-4J.

As described above, the portion of the display screen 248 rendering the live video of the competitive contest may be used to display or render alternative content when a break in the competitive contest is determined (step 816). The break in the competitive contest may correspond to a break in coverage, a break in action, a timeout, a commercial break, a pause between contests, a conclusion of the competitive contest, combinations thereof, and the like. The break may be determined by the contest video server 164 sending a signal that includes information about the break to the gaming server 116 and/or the gaming device 108. This information may include a time associated with the break, a length of the break, and/or other information that may be used by the gaming device 108 to automatically alter a presentation of information displayed to the portion of the display screen 248 reserved for the live video of the competitive contest.

The method may continue, when there is a break in the competitive contest, by rendering a different interactive game to the portion of the display screen 248 reserved for the live video of the competitive contest, at least during the break (step 820). The different interactive game may correspond to a side game or a temporary game that the player can play via the gaming device 108 at least during the break. The different interactive game rendered to one portion of the display screen 248 may be played simultaneously with or while the interactive game is being played and rendered to another portion of the display screen 248.

Additionally or alternatively, the portion of the display screen 248 reserved for the live video of the competitive contest may include information about the break, such as, the type of break, a duration of the break, a countdown timer, and/or the like. One example of an interactive game that can be played at the gaming device 108 during a break is described and shown in conjunction with FIG. 4D. The method may proceed by determining if live video of the competitive contest is available. In some cases, when the competitive contest returns from a break, the player may be provided an opportunity to continue the side game, pause the side game, or switch to watching the competitive contest via the portion of the display screen 248 reserved for the live video of the competitive contest. In some embodiments, the method may proceed by rendering a split-screen to the display screen 248 allowing the player to continue to play the side game while watching the live video of the competitive contest.

In addition to the embodiments described above, the present disclosure offers a number of additional benefits and features.

In one embodiment, the gaming device may learn there is a fumble in a football game and, in response, visually spin slot reels backwards, erratically, drop a reel, or even change an orientation of the slot reels. In one embodiment, the gaming device may learn that there is a penalty in the game and a poker game being played on the gaming device may determine to re-deal the poker hand. In one embodiment, the gaming device may learn that a holding penalty is called during a football game and one or more slot reels may be "held" while the other reels are allowed to spin as usual. In other words, the gaming behavior or presentation for the casino game being played on the gaming device may be designed to match a type of the event in the sporting game the player placed a bet on. In one embodiment, the gaming device may learn that there is a score in the sporting game and, in response, may play an animation, a sound, or alter the interactive game visually to indicate the score in the sporting game.

In some embodiments, the gaming device may learn that a player is betting on certain teams, sports, and/or races. In response, the graphics, videos, and sounds for the casino game being played on the gaming device may be altered to match what the player is betting on. In one embodiment, the card backs in a poker game on the gaming device may be replaced with the logo of the team the player bet on. In one embodiment, the slot symbols may be replaced by images of players of a certain team, etc.

The sporting event might only be used by the gaming device to visually alter the casino game, but the event could also be used by the gaming device to alter the payback of the casino game played thereon. The event could also be used to alter the awarding of player points, virtual currency, or other awards by the gaming device. In one embodiment, the player may receive a higher payback when their favorite team is winning or when they are currently winning in a bet. For example, the player may like the team called the Cowboys. When the Cowboys are winning, the software of the gaming device may pay 100 credits for a three-cherry win (e.g., on a slots game) instead of the standard 90 credits for the same win at a different gaming device where no team preferences are considered. In some embodiments, the player may earn more player tracking points when their team is winning. In another embodiment, the player may earn more player tracking points while their team is ahead by a certain margin, such as being ahead by ten or more points, etc. In one embodiment, the player may earn more player points on one or more casino game play after their team scores or achieves some other goal in the actual sports game. For example, the player may receive double player points for credits bet after a first down until the next play.

In some embodiments, certain prizes may only be available to players who participate in sports/race betting from their gaming devices. For example, a progressive pot may only be available to players betting on sports or on a certain sport, race, or game. In one embodiment, the player may be allowed an additional bet, such as a side bet, only when the player is engaged in sports/race betting at the gaming device.

In one embodiment, the casino game on a gaming device may speed up when the player's team is ahead. For example, the reels of a slots game may spin faster and faster the more the player's team is ahead. Additionally or alternatively, the sounds produced by the gaming device while playing the interactive game may intensify (e.g., increase in volume, tempo, pitch, etc.) while the player's team is ahead or is advancing in the game.

The gaming device may detect a time out, penalty, commercial, or other break in the live sports game, or race, and encourage the player to play casino games during that period. For example, the player may be watching football and a time out may be called. During the time out, the gaming device could open, bring up, or maximize, a video poker window during the time out. When the football game resumes the poker screen could minimize, become smaller, or disappear.

In another embodiment the gaming device may include two discrete displays (e.g., monitors). The player may be able to watch the live video of the sports game or race on the main display (e.g., the lower or main monitor) and play video poker on the other display (e.g., the top monitor). When a break in action happens, the sports/race betting may move to the top monitor and the video poker (or other casino game) may move to the main monitor. When the break is finished, the monitors may return to their original configuration and display presentation.

Some sports events may be considered negative for the team a player is betting on, such as a fumble, penalty, etc. Similarly, certain racing events may be considered negative for a particular entity (e.g., horse, dog, etc.) that a player is betting on, such as a thrown shoe, an injury, a failure to start, a faulty gate associated with the entity, etc. In these cases, the player may lose a reel, a choice card, etc. The player may lose the ability to have a feature such as a bonus, progressive, mystery progressive or pay-table category (e.g., player can no longer be paid for a four-cherry win, etc.).

In some embodiments, the interactive game provided by the gaming device may have additional features if the player is engaged in sports/race betting via the gaming device. For instance, the player may be allowed additional choices, cards, reels, or bonuses if the player is engaged in sports/race betting. The features may require that the player sport bet a certain amount of money, number of games, or amount of money per unit of time.

Any of the embodiments described herein may be triggered, enabled, or scaled by any one or more factors including, but in no way limited to, the number of sports/race betting games currently active by the player, the total amount of money bet on a race or sports betting game by the player, the average amount of money bet on races or sports, the player loyalty account status for the player—certain features, payouts, etc. may be increased with account status, the total amount bet on casino games over a period of time, the average amount of bet on casino games over a period of time, the current bet or denomination currently played on the casino games played on the gaming device, and the like.

In some embodiments the sporting events, score, yards, or other numeric value, may be used to influence slot game behavior provided by a gaming device. For example, the slot machine behavior may change when the point differential in a game increases or decreases or the number of runs accumulated for running or passing increases. As another example, the speed of the slot reels may increase as the player's favorite team increases a lead against an opposing team. In another American football example, the game might change appearance, volume, or speed with each down such that the first down and the fourth down are associated with different levels of visual and auditory excitement for a player (e.g., faster speed, louder volume levels, and/or more interactive lighting may be associated with an exciting fourth down play, while slower speeds, lower volume levels, and/or subdued less interactive lighting may be associated with a less exciting first down play, etc.).

Various awards and benefits have been described for the player who is using casino gaming in combination with sports/race betting at a gaming device. These awards may include, but are in no way limited to, money, virtual currency, player points, show tickets, buffet tickets, coupons or discounts to use services at the casino, and/or the like.

In some embodiments, players who bet and game at a gaming device may be enrolled in mystery progressives. Mystery progressives are a casino floor feature where a player is randomly chosen to win a prize. It is an aspect of the present disclosure that the selection of the winning player and the amount of the mystery progressive could all come from real-time sports/race betting or real-time sports/race events. In one embodiment, only players participating in sports/race betting or those playing at a sports/race betting gaming device may be eligible for certain mystery progressives. In one embodiment, the mystery progressive may be triggered by a particular event, or randomly chosen at a particular event such as a touchdown in a football game. In one embodiment, the mystery progressive may be triggered at the end of the game. Only players at gaming devices who be on the winning team (or player of the team with the most yards, etc.) via the gaming devices may be eligible for the mystery progressive. In one embodiment, the amount of the prize may be directly taken from the event. For example, the mystery progressive is triggered and awarded to Player A. The amount given to Player A is the number of yards the winning team advanced in the game. For example, the team called the Cowboys may have advanced a total of 350 yards, so Player A may be awarded $350. In another embodiment, the losing team also may be eligible for a mystery progressive of a different (lower) amount. That lower amount may be a fixed value or may scale with points scored or yards advanced. In another embodiment, the mystery progressive is some base amount plus some additional amount proportional to how well the player's team performed. For example, the mystery progressive could be $50 plus 10% of each yard the team ran during the game.

In some jurisdictions, there are requirements that the casino limit anonymous play. For example, some regulations state that sports/race betting personnel and terminals must limit a single person to no more than $10,000 in wagers per day. Today, a clerk at a desk accepts bets and notes the information about the player such as age, gender, shirt color, etc. This information may be stored in the Sports Betting System or in a Race Betting System. This information is used to attempt to identify players betting more than the limit.

As provided above, the gaming device can have a video camera which is able to capture video or still images. The camera can capture an image of the player making the bet and send that image to the Sport Betting System (e.g., the betting system server). In another embodiment, the gaming device, gaming server, or the betting system server (e.g., host) analyzes the image of the player and determines the player's age, gender, clothing color and other details. This information may be added to the Sports Betting System. If a player places bets at the terminal and then goes to the desk the clerk can detect that the player is attempting to place excessive bets. In another embodiment, the player attempts to exceed the limit after betting many times from one or more gaming devices. The gaming devices report the player age, gender, clothing etc. to the Sports Betting System and the System notices that the bets may exceed the daily limits. In response, the Sports Betting System can notify an attendant to manually confirm the bet before allow the bet to be placed. The attendant might have a table or mobile device where the attendant is able to review the images of all the bets placed where the age, gender and clothing are similar to the current player. The attendant and approve or disapprove of the bet.

In some embodiments, the player may be offered a better sports betting opportunity for participating in casino gaming. For example, the team called the Cowboys may be favored to win by 10 points. The player can win a "negative point" allowing her/him to bet on the Cowboys by +9 instead of +10 if the player participates in gaming via the gaming device. It may be possible for the player to accumulate these negative points. In some embodiments the offer might be time limited. This approach would help a sports book balance the betting by automatically keeping the bets 50/50 on both sides of any bet. The benefit may continue as long as the player engages in casino gaming at a gaming device or maintains a certain amount of play on casino gaming at a gaming device. A casino may offer increased "teaser" odds where the player can get a greater number of points to adjust the line on a sports bet than are normally offered by a casino. As an example, instead of allowing a player to play a 7-point teaser where the betting line on a game can be adjusted by 7 points on each game chosen, a player can become eligible for a 15-point teaser.

Casinos offer parlay betting especially for football. The player picks the winner in a group of games, for example by picking all of the winners for all the football games this week. Sometimes the casino offers these games for free to incentivize players to visit the casino. The casino often has a fixed prize that all winners (if any) are given. The casino game on the gaming device may award the player a sports bet and specifically a parlay game bet. For example, the player may hit a bonus and win a large prize which includes one parlay card for this week's NFL games. The player may pick the teams on the gaming device or on a mobile device. The gaming device might print a ticket for the player to redeem at a traditional sports betting desk.

Embodiments of the present disclosure may allow the player to bet on individual events in a game via the gaming device. For example, the player may be allowed to bet on each down of a football game. The player can bet if the team passes or runs and how many yards are advanced or lost. The player can bet if the team runs left or right. The player can bet if the teams kicks a field goal successfully. In any event, these real-time betting features can also be linked to casino gaming at the gaming device. For example, the player might bet on each down of a football game and play a slot game on the gaming device at the same time. If the player engages in both types of wagering at the same time, incentives may be provided in the sports betting and in the slot game provided by the gaming device. Additionally or alternatively, a player may be offered one or more incentives for betting on more than one competitive contest (e.g., sporting event, race, etc.) at a time. For instance, when a player bets on multiple competitive contests, the player may be presented with better odds for the interactive game rendered to the interactive game window 404 of the gaming device 108. In some embodiments, betting on multiple competitive contests may trigger the gaming device 108 to provide additional features in a game as described in conjunction with FIGS. 4A-4J, etc.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A computer gaming device and betting terminal, comprising:

a display device;

a communications interface;

a processor coupled to the display device and the communications interface; and a memory coupled with and readable by the processor and storing therein a set of instructions that, when executed by the processor, causes the processor to:

receive, via the communications interface, information from a betting system comprising betting events associated with competitive contests;

render an interactive game that is unrelated to the competitive contests to a first portion of the display device in a first presentation;

receive playing input from a user interacting with the computer gaming device playing the interactive game;

render the information received from the betting system to a second portion of the display device while simultaneously rendering the interactive game to the first portion of the display device;

receive betting input, independent of the playing input and unrelated to the interactive game, from the user interacting with the computer gaming device placing a bet on a particular contest of the competitive contests;

send, via the communications interface, a signal comprising information defining the bet to the betting system on behalf of the user; and alter, automatically in response to receiving a signal of an event associated with the particular contest, a game behavior of the interactive game that is rendered to the first portion of the display device when the event affects the bet.

2. The device of claim 1, wherein the set of instructions further causes the processor to:

render information about the event associated with the particular contest to the display device; and alter the first presentation of the interactive game rendered to the display device to a different second presentation of the interactive game rendered to the display device when the event affects the bet.

3. The device of claim 2, wherein the set of instructions further causes the processor to:

increment a value of a record stored in the memory defining an amount for interactions made by the user in the interactive game when the event associated with the particular contest positively affects the bet; and decrement a value of a record stored in the memory defining an award for interactions made by the user in the interactive game when the event associated with the particular contest negatively affects the bet.

4. The device of claim 3, wherein the set of instructions further causes the processor to:

establish, via the communications interface, a communications session across a communication network to an event data origination source, wherein the event data origination source comprises a server with events recorded for the particular contest stored in a memory of the server; and detect the events recorded for the particular contest in real-time.

5. The device of claim 3, wherein the set of instructions further causes the processor to:

send, via the communications interface, a message comprising information associated with the bet and the interactive game to a central gaming server, wherein the message causes the central gaming server to determine whether the user should be entered into a wager pool with other users.

6. The device of claim 1, herein the of instructions further causes the processor to:

receive, via the communications interface, a live video feed associated with the particular contest; and render the live video feed to a third portion of the display device while simultaneously rendering the interactive game to the first portion of the display device.

7. The device of claim 6, wherein the set of instructions further causes the processor to:

determine, prior to receiving the live video feed, whether the user bet on the particular contest;

grant access to the live video feed when the user is determined to have bet on the particular contest; and restrict access to the live video feed when the user is determined to have not bet on the particular contest.

8. The device of claim 6, wherein the set of instructions fu causes the processor to:

render the first portion in a first resizable window;

render the second portion in a second resizable window; and render the third portion in a third resizable window.

9. The device of claim 8, wherein the set of instructions further causes the processor to:

determine, based on information received from the live video feed, a break in action in the particular contest; and scale, for a time associated with the break in action, the first resizable window to a size greater than a size of the third resizable window.

10. The device of claim 9, wherein the set of instructions further causes the processor to:

render a countdown timer corresponding to the time associated with the break in action to a fourth portion of the display device.

11. A method for providing interactive gaming and competitive contest wagering at a gaming device, comprising:

receiving, via a communications interface of the gaming device, information from an online wagering system comprising wagering events associated with competitive contests;

rendering, via a processor of the gaming device, an interactive game that is unrelated to the competitive contests to a first portion of a screen of the gaming device in a first presentation;

receive, via an input device of the gaming device, playing input from a user interacting with the gaming device playing the interactive game;

rendering, via the processor, the information received from the online wagering system to a second portion of the screen while simultaneously rendering the interactive game to the first portion of the display device;

receiving, via an input device of the gaming device, betting input, independent of the playing input and unrelated to the interactive game, from the user interacting with the gaming device placing a wager on a particular contest of the competitive contests;

sending, via the communications interface, a signal comprising information defining the wager to the online wagering system on behalf of the user; and altering, automatically via the processor in response to receiving a signal of an event associated with the particular contest, a game behavior of the interactive game that is rendered to the first portion of the display device when the event affects the wager.

12. The method of claim 11, further comprising:

rendering, via the processor, information about the event associated with the particular contest to the screen; and altering, via the processor, the first presentation of the interactive game rendered to the screen to a different second presentation of the interactive game rendered to the screen when the event affects the wager.

13. The method of claim 12, wherein altering the first presentation to the different second presentation comprises altering a visual effect for elements rendered in the first presentation to a different visual effect for the elements rendered in the different second presentation.

14. The method of claim 12, further comprising:

incrementing, via the processor, a value of a record stored in a memory defining an award amount for interactions made by the user in the interactive game when the event associated with the competitive contests or the particular contest positively affects the wager; and decrementing, via the processor, a value of a record stored in a memory defining an award amount for interactions made by the user in the interactive game when the event associated with the competitive contests or the particular contest negatively affects the wager.

15. The method of claim 14, further comprising:

establishing, via the communications interface, a communications link across a communication network to an event data origination source, wherein the event data origination source comprises a server with events recorded for the particular contest stored in a memory of the server; and detecting, via the processor, the events recorded for the particular contest in real-time or near-real-time.

16. The method of claim 14, further comprising:

sending, via the communications interface, a message comprising information associated with the wager and the interactive game to a central gaming server, wherein the message causes the central gaming server to determine whether the user should be entered into a wager pool with other users playing a version of the interactive game or wagering on the particular contest.

17. The method of claim 11, further comprising:

receiving, via the communications interface, a live video feed of the particular contest; and rendering, via the processor, the live video feed to a third portion of the screen while simultaneously rendering the interactive game to the first portion of the display device.

18. The method of claim 17, wherein the first portion is rendered in a first resizable window, the second portion is rendered in a second resizable window, and the third portion is rendered in a third resizable window, and wherein the method further comprises:

determining, via the processor and based on information received from the live video feed, a break in action in the particular contest; and scaling, via the processor for a time associated with the break in action, the first resizable window to a size greater than a size of the third resizable window.

19. A system for placing bets via a gaming terminal, comprising:

a betting server; and a gaming terminal in communication with the betting server, the gaming terminal comprising:

a display device;

a communications interface;

a processor coupled to the display device and the communications interface; and a memory coupled with and readable by the processor and storing therein a set of instructions that, when executed by the processor, causes the processor to:

receive, via the communications interface, information from the betting server comprising betting events associated with competitive contests;

render an interactive game that is unrelated to the competitive contests to a first portion of the display device in a first presentation;

receive playing input from a user interacting with the computer gaming device playing the interactive game;

render the information received from the betting server to a second portion of the display device while simultaneously rendering the interactive game to the first portion of the display device;

receive betting input, independent of the playing input and unrelated to the interactive game, from the user interacting with the gaming terminal placing a bet on a particular contest of the competitive contests;

send, via the communications interface, a signal comprising information defining the bet to the betting server on behalf of the user; and alter, automatically in response to receiving a signal of an event associated with the particular contest, a game behavior of the interactive game that is rendered to the first portion of the display device when the event affects the bet.

20. The system of claim 19, wherein the communications interface comprises a first communications port and a second communications port separate from the first communications port, wherein the information from the betting server is received via the first communications port, the system further comprising:

a live video source connected to the communications interface via the second communications port, wherein the set of instructions further causes the processor to receive, via the live video source, a live video feed of the particular contest and render the live video feed to a third portion of the display device while simultaneously rendering the interactive game to the first portion of the display device.

* * * * *